US012618309B1

(12) United States Patent
Parsinejad et al.

(10) Patent No.: US 12,618,309 B1
(45) Date of Patent: May 5, 2026

(54) METHODS FOR PREVENTING CORROSION IN FLEXIBLE PIPE WITH PASSIVATING AGENTS

(71) Applicants: Chevron Oronite Company LLC, San Ramon, CA (US); Chevron U.S.A. Inc., San Ramon, CA (US)

(72) Inventors: Farzan Parsinejad, Houston, TX (US); Antonio Critsinelis, Kingwood, TX (US); William R. Ruhe, Jr., Benicia, CA (US); Man Kit Ng, El Sobrante, CA (US)

(73) Assignees: Chevron U.S.A. Inc., San Ramon, CA (US); Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 19/201,397

(22) Filed: May 7, 2025

(51) Int. Cl.

| | |
|---|---|
| ***E21B 43/34*** | (2006.01) |
| ***E21B 41/02*** | (2006.01) |
| *E21B 17/01* | (2006.01) |
| *E21B 17/20* | (2006.01) |

(52) U.S. Cl.
CPC ..... *E21B 41/02* (2013.01); *E21B 17/01* (2013.01); *E21B 17/203* (2013.01)

(58) Field of Classification Search
CPC ..... E21B 43/34; E21B 41/02; C09K 8/40
USPC ..... 166/310
See application file for complete search history.

(56) References Cited

U.S. PATENT DOCUMENTS

| | | | | |
|---|---|---|---|---|
| 7,077,219 | B1 * | 7/2006 | Chatterji | C09K 8/38 166/309 |
| 8,783,358 | B2 | 7/2014 | Critsinelis | |
| 8,820,412 | B2 * | 9/2014 | Critsinelis | E21B 41/04 166/344 |
| 11,066,596 | B2 * | 7/2021 | Xu | C09K 8/665 |
| 11,718,777 | B2 * | 8/2023 | May | E21B 33/138 166/295 |

OTHER PUBLICATIONS

Soltex, Polybutenes, Jun. 14, 2021, https://soltexinc.com/wp-content/uploads/2021/06/TDS_PB-6-128-FINAL-210614.pdf.
Obot, I.B., et al., Progress in the development of sour corrosion inhibitors: Past, present, and future perspectives, J. of Industrial and Engineering Chemistry, Nov. 25, 2019, vol. 79, p. 1-18.
Aculon, Oil & Gas Surface Coating Applications, Sep. 20, 2022, https://www.aculon.com/oil-gas/.

* cited by examiner

*Primary Examiner* — William D Hutton, Jr.
*Assistant Examiner* — Ashish K Varma
(74) *Attorney, Agent, or Firm* — King & Spalding LLP

(57) ABSTRACT

Disclosed are methods and apparatus for preventing corrosion within the annulus of a flexible pipe used in a riser in an offshore hydrocarbon production facility. Buffer fluid comprising a passivating agent is introduced into the annulus to form protective layers on metal surfaces within the annulus to resist corrosive materials from contacting the metal surfaces. The passivating agents may be one or more of a polyalphaolefin, a polybutene, or a polysiloxane. A corrosion inhibitor may be combined with the passivating agent in the buffer fluid. Pretreating of the metal surfaces within the annulus prior to introduction of the buffer fluid can be performed with a pretreating corrosion inhibitor.

22 Claims, 20 Drawing Sheets

NON-COATED Steel Test Rod evaluated with oil +DI water.

Polydimethylsiloxane (DMS T-12) @4HRS

NON-COATED Steel Test Rod evaluated with oil +DI water.

Polydimethylsiloxane (DMS T-12) @ 24HRS

COATED Steel Test Rod evaluated with oil +DI water

Polydimethylsiloxane (DMS T-12) @4Hrs.

COATED Steel Test Rod evaluated with oil +DI water

Polydimethylsiloxane (DMS T-12) @24Hrs.

NON-COATED Steel Test Rod evaluated with oil +DI water.

PB-6 (Polybutene) @4HRS

NON-COATED Steel Test Rod evaluated with oil +DI water.

PB-6 (Polybutene) @24HRS

COATED Steel Test Rod evaluated with oil +DI water.

PB-6 (Polybutene) @4Hrs

COATED Steel Test Rod evaluated with oil +DI water.

PB-6 (Polybutene) @24Hrs

NON-COATED Steel Test Rod evaluated with oil +DI water.

PAO 4 (Spectrasyn) @4HRS

NON-COATED Steel Test Rod evaluated with oil +DI water.

PAO 4 (Spectrasyn) @24HRS

COATED Steel Test Rod evaluated with oil +DI water.

PAO 4 (Spectrasyn) @24hrs

COATED Steel Test Rod evaluated with oil +DI water.

PAO 4 (Spectrasyn) @24hrs

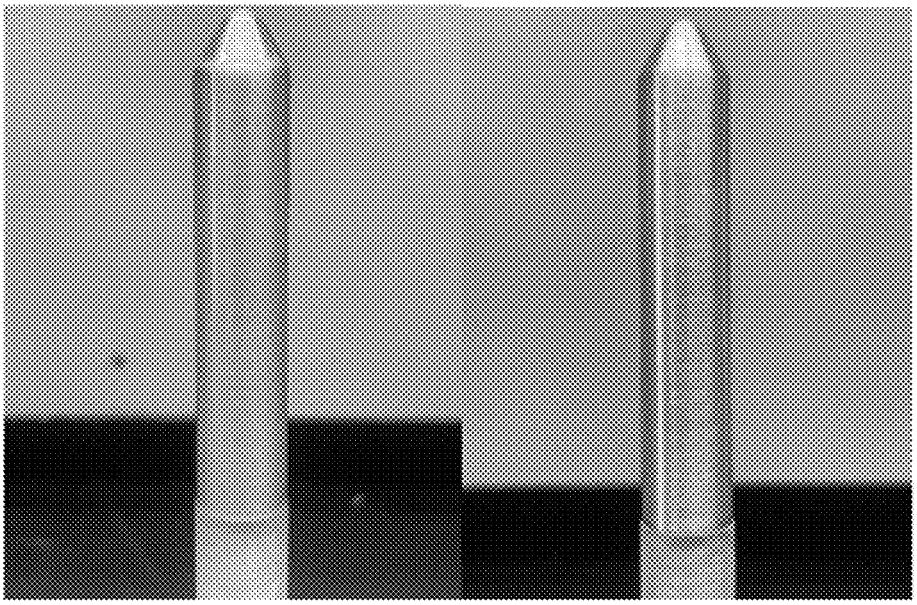

NON-COATED Steel Test Rod evaluated with oil +DI water.

PB-6 (Polybutene) w/ Rust Inhibitor A 1.05wt% @4Hrs.

NON-COATED Steel Test Rod evaluated with oil +DI water.

PB-6 (Polybutene) w/ Rust Inhibitor A 1.05wt% @24Hrs.

FIG. 13A

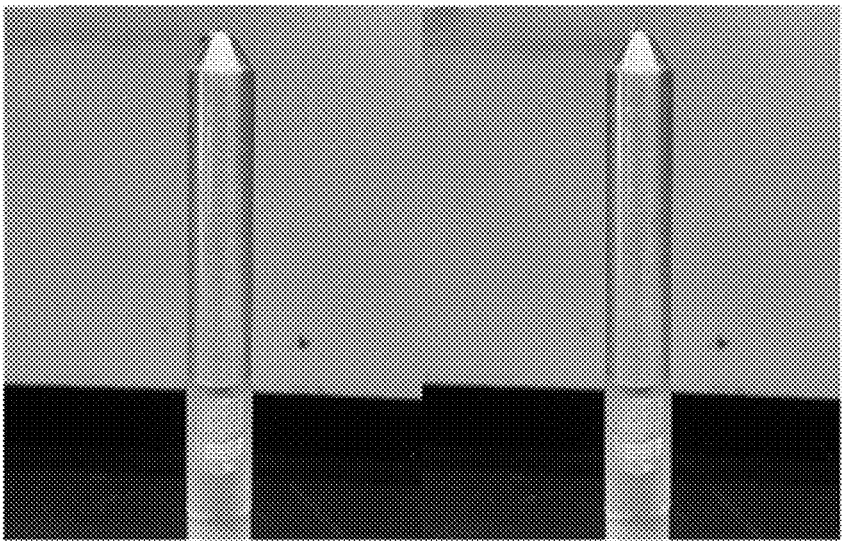

COATED Steel Test Rod evaluated with oil +DI water.

PB-6 (Polybutene) w/ Rust Inhibitor A 1.05wt% @4Hrs.

COATED Steel Test Rod evaluated with oil +DI water.

PB-6 (Polybutene) w/ Rust Inhibitor A 1.05wt% @ 24Hrs.

FIG. 13B

NON-COATED Steel Test Rod evaluated with oil +DI water.

PAO 4 w/ Rust Inhibitor A 1.05wt% @4Hrs.

NON-COATED Steel Test Rod evaluated with oil +DI water.

PAO 4 w/ Rust Inhibitor A 1.05wt% @24Hrs.

COATED Steel Test Rod evaluated with oil +DI water.

PAO 4 w/ Rust Inhibitor A 1.05wt% @4Hrs.

COATED Steel Test Rod evaluated with oil +DI water.

PAO 4 w/ Rust Inhibitor A 1.05wt% @ 24Hrs.

NON-COATED Steel Test Rod evaluated with oil +DI water.

PAO 4 w/ Rust Inhibitor A 0.7wt% @4Hrs.

NON-COATED Steel Test Rod evaluated with oil +DI water.

PAO 4 w/ Rust Inhibitor A 0.7wt% @24Hrs.

COATED Steel Test Rod evaluated with oil +DI water.

PAO 4 w/ Rust Inhibitor A 0.7wt% @4Hrs.

COATED Steel Test Rod evaluated with oil +DI water.

PAO 4 w/ Rust Inhibitor A 0.7wt% @24Hrs.

NON-COATED Steel Test Rod evaluated with oil +DI water.

PAO 4 w/ Rust Inhibitor A 0.5wt% @4Hrs.

NON-COATED Steel Test Rod evaluated with oil +DI water.

PAO 4 w/ Rust Inhibitor A 0.5wt% @24Hrs.

COATED Steel Test Rod evaluated with oil +DI water.

PAO 4 w/ Rust Inhibitor A 0.5wt% @4Hrs.

COATED Steel Test Rod evaluated with oil +DI water.

PAO 4 w/ Rust Inhibitor A 0.5wt% @24Hrs.

METHODS FOR PREVENTING CORROSION IN FLEXIBLE PIPE WITH PASSIVATING AGENTS

TECHNICAL FIELD

The present disclosure relates to the use of polysiloxane compounds, polyalphaolefins, and/or polybutene for preventing corrosion on flexible pipelines.

BACKGROUND

Flexible pipes used in oil and gas production are composed of densely packed steel wires enclosed in an annulus confined by inner and outer thermoplastic sheaths (pressure barriers). Hydrocarbons, water, $CO_2$ and $H_2S$ from the bore diffuse through the inner sheath and form a corrosive environment in the confined space between the sheaths.

Carbon dioxide-induced stress corrosion cracking is an environmentally assisted corrosion cracking phenomenon that has recently been identified as a new failure mode in flexible pipe armor wires. The phenomenon has been observed to take place notably in severe $CO_2$ environments and is a cause of great concern to the flexible pipe industry.

Engineered flexible pipe is frequently used in riser applications in offshore hydrocarbon production facilities which convey hydrocarbon products from a subsea well to a topsides production platform or vessel. Such flexible pipe is formed of multiple layers, each layer designed for a specific function. In general, the innermost layer of the multiple layers is the carcass layer, made of corrosion resistant material, designed to resist collapse of the flexible pipe. Surrounding the carcass is a polymeric sealant layer or pressure sheath which is extruded around the carcass and sealed at flexible pipe end fittings to contain fluid within the bore. Surrounding the polymeric sealant layer is an annulus containing a number of metallic armor layers designed to impart strength against tensile loading (e.g. armor wires) and internal pressure loading (e.g., pressure armor). Surrounding these layers is another polymeric sealant layer or external sheath designed to avoid external sea water ingress into inner layers of the flexible pipe, which acts as an outer protective layer. The space between the two polymeric sealant layers is referred to as "the annulus." Typically, the annulus contains one or more layers of circumferentially oriented steel members (referred to as pressure armor layers) designed to provide radial strength and burst resistance due to internal pressure. Surrounding the pressure armor layers are layers of helically wound armor wires (referred to as armor wire layers) designed to provide tensile strength in the axial direction.

Flexible pipe is terminated at each end by an end fitting which incorporates a flange for mating with other flanges. In use, flexible pipe risers are suspended from an offshore hydrocarbon production platform or host facility, thus placing high tensile loads on the armor wire layers. The loads along the riser are amplified due to the effects of environmental conditions and associated motions of the platform or host facility to which the riser is connected.

Within the bore of the flexible pipe, in addition to hydrocarbon products, other components including hydrogen sulfide, carbon dioxide and water may be present. These other components can diffuse through the first polymeric sealant layer (pressure sheath) to the annulus. These components, hydrogen sulfide in particular, as well as water vapor, can accumulate within the annulus and eventually lead to corrosion of the steel wires therein via mechanisms including hydrogen induced cracking and sulfide stress cracking. Additionally, the annulus can be flooded with seawater due to damage of the outermost layer leading to corrosion of the armor wires. As noted, the armor wires in the flexible riser are particularly subject to dynamic cyclic loads, which can result in corrosion fatigue of the metallic armor wires in the annulus. Corrosion of the metallic wires in this region makes these wires particularly vulnerable to corrosion fatigue and potential acceleration of failure mechanism.

In view of the foregoing, there is an ongoing need to prevent or reduce corrosion of the armor wires and other steel elements within the annulus of flexible pipe used in risers and in other dynamic applications.

SUMMARY

This summary is provided to introduce various concepts in a simplified form that are further described below in the detailed description. This summary is not intended to identify required or essential features of the claimed subject matter nor is the summary intended to limit the scope of the claimed subject matter.

Aspects of this disclosure are directed to methods for preventing or reducing corrosion by circulating buffer fluid comprising one or more passivating agents within the annulus of a flexible pipe used in a riser, flowlines and jumpers in an offshore hydrocarbon production facility.

In one aspect of the present disclosure, a flexible pipe apparatus for use in a riser system in an offshore hydrocarbon production facility is provided. The apparatus includes a tubular carcass layer defining a bore therein for transporting produced well fluids, a pressure sheath surrounding the carcass layer, an external sheath surrounding the pressure sheath and defining an annulus there between, and at least one tube within the annulus having at least one opening for introducing buffer fluid to the annulus; wherein the surfaces of the pressure sheath and the external sheath in contact with the buffer fluid passing through the annulus are at least partially coated with one or more passivating agents as described herein. In one embodiment, the passivating agents comprise a polyalphaolefin compound. In another embodiment, the passivating agents comprise a polybutene compound. In yet another embodiment, the passivating agents comprise a polysiloxane compound. In the foregoing embodiments, the buffer fluid may also include a corrosion inhibitor in combination with the passivating agent. Furthermore, in the foregoing embodiments, the surfaces within the annulus of the flexible pipe apparatus may be treated, before introducing the buffer fluid, with a pretreating corrosion inhibitor such as a hydrophobic silane.

In another aspect of the present disclosure, a method is provided for preventing or reducing corrosion within the annulus of a flexible pipe riser in an offshore hydrocarbon production facility. The method includes pumping a buffer fluid comprising one or more passivating agents into an inlet port in a topsides riser end fitting in fluid communication with a plurality of tubes within an annulus of a flexible pipe riser wherein each of the plurality of tubes comprises at least one opening within the annulus, the flexible pipe riser comprising one end terminating at the topsides riser end fitting in fluid communication with the plurality of tubes within the annulus and another end terminating at a subsea riser end fitting. The buffer fluid is discharged from the openings of the plurality of tubes into the annulus such that the buffer fluid flows in the annulus. In one embodiment, the one or more passivating agents comprise a polyalphaolefin compound. In another embodiment, the one or more passivating agents comprise a polybutene compound. In yet another embodiment, the one or more passivating agents comprise a polysiloxane compound. In the foregoing embodiments, the buffer fluid may also include one or more corrosion inhibitors in combination with the one or more passivating agents. Furthermore, in the foregoing embodiments, the surfaces within the annulus of the flexible pipe apparatus may be treated, before introducing the buffer fluid, with a pretreating corrosion inhibitor such as a hydrophobic silane.

This summary and the following detailed description provide examples and are explanatory only of the disclosure. Accordingly, the foregoing summary and the following detailed description should not be considered to be restrictive. Additional features or variations thereof can be provided in addition to those set forth herein, such as for example, various feature combinations and sub-combinations of these described in the detailed description.

BRIEF DESCRIPTION OF THE DRAWINGS

These and other objects, features and advantages of the present invention will become better understood with regard to the following description, appended claims and accompanying drawings where:

FIG. 13A illustrates ASTM D665 test results for two steel rods, each of which was submerged in distilled water with a buffering fluid comprising a polybutene and an alkenylsuccinic acid-based corrosion inhibitor.

FIG. 13B illustrates ASTM D665 test results for two steel rods, each of which received a silane pretreating corrosion inhibitor followed by submersion in distilled water with a buffering fluid comprising a polybutene and an alkenylsuccinic acid-based corrosion inhibitor.

DEFINITIONS

Figure 1B:
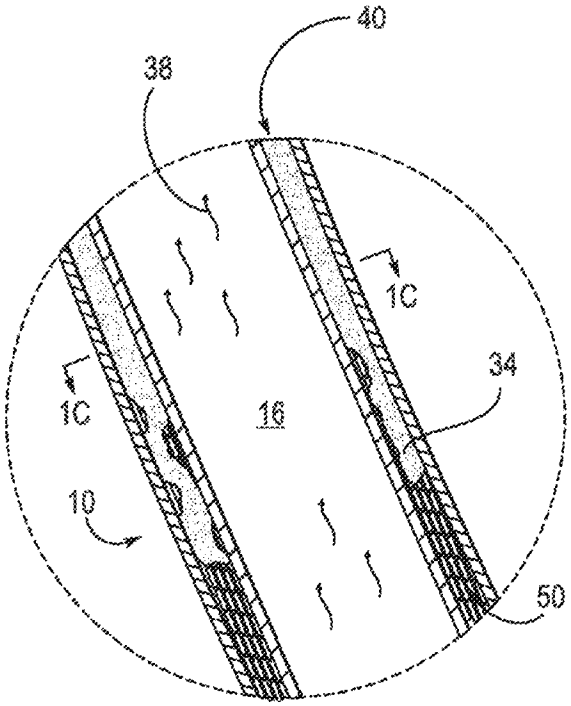
FIGS. 1A-1E illustrate a system and apparatus for circulating fluid within the annulus of a flexible pipe riser in an offshore hydrocarbon production facility according to one embodiment.
Figure 1A:
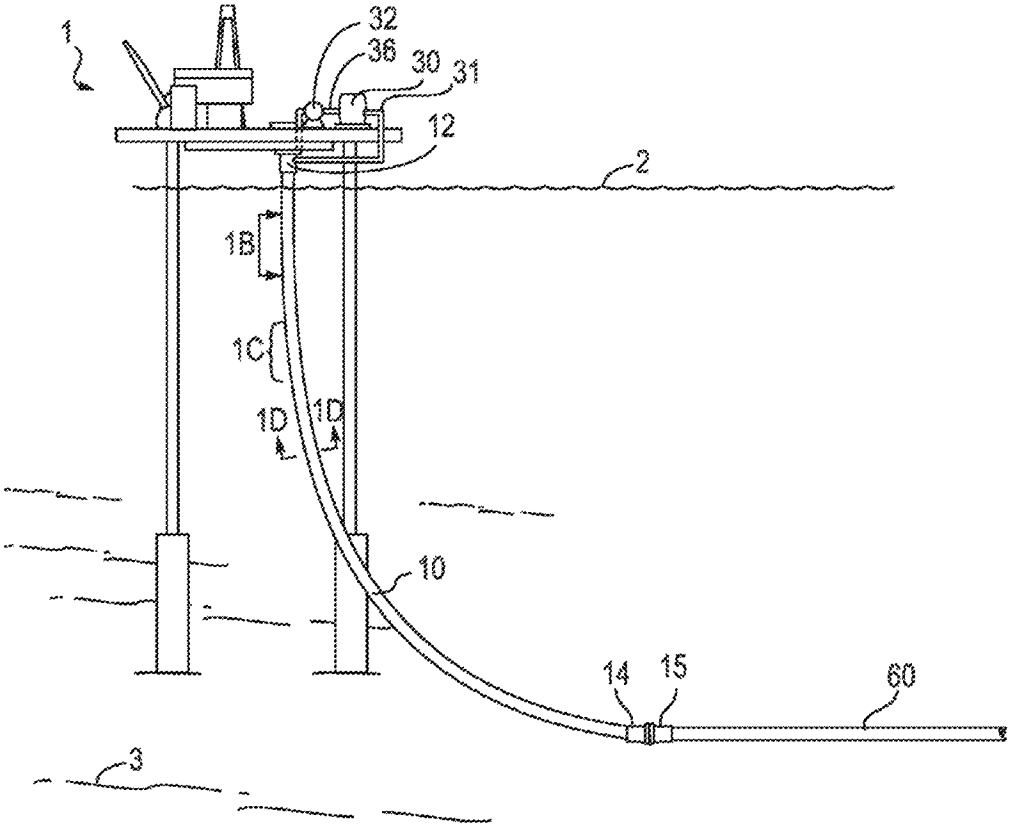

To define more clearly the terms used herein, the following definitions are provided. Unless otherwise indicated, the following definitions are applicable to this disclosure. If a term is used in this disclosure but is not specifically defined herein, the definition from the IUPAC Compendium of Chemical Terminology can be applied, as long as that definition does not conflict with any other disclosure or definition applied herein, or render indefinite or non-enabled any claim to which that definition is applied. To the extent that any definition or usage provided by any document incorporated herein by reference conflicts with the definition or usage provided herein, the definition or usage provided herein controls.

While compositions and methods are described in the Detailed Description section in terms of "comprising" various components or steps, the compositions and methods can also "consist essentially of" or "consist of" the various components or steps, unless stated otherwise.

The terms "a," "an," and "the" are intended to include plural alternatives, e.g., at least one. The terms "including", "with", and "having", as used herein, are defined as comprising (i.e., open language), unless specified otherwise.

Various numerical ranges are disclosed herein. When Applicant discloses or claims a range of any type, Applicant's intent is to disclose or claim individually each possible number that such a range could reasonably encompass, including end points of the range as well as any sub-ranges and combinations of sub-ranges encompassed therein, unless otherwise specified. All numerical end points of ranges disclosed herein are approximate, unless excluded by proviso. For example, the range "$C_1$ to $C_4$" alkyl independently includes $C_1$, $C_2$, $C_3$ and $C_4$ alkyl groups. When such a range is stated, each element has been contemplated and the range is used merely for convenience.

The term "polybutene" refers to an olefinic polymer formed from an isobutene-rich stream of butene monomers, wherein polybutene comprises 60% to 100% isobutene and 0% to 40% of 1-butene and/or 2-butene monomers.

The term "passivating" refers to rendering a metal or other substance unreactive by altering the surface layer or coating the surface with a thin, inert layer sufficiently to reduce or prevent corrosion.

Generally, while the compounds, compositions and methods are described in terms of "comprising" various components or steps, the compounds, compositions and methods can also "consist essentially of" or "consist of" the various components and steps.

The term "alkyl", as used herein, unless otherwise specified, includes a saturated straight, branched, cyclic, primary, secondary, or tertiary hydrocarbon. The term includes both substituted and unsubstituted alkyl groups. Moieties with which the alkyl group can be substituted include, but are not limited to, hydroxyl, halo (F, Cl, Br, I), amino, alkylamino, arylamino, alkoxy, aryloxy, nitro, cyano, sulfonic acid, sulfate, phosphonic acid, phosphate, or phosphonate, either unprotected, or protected as necessary, as known to those skilled in the art, for example, as taught in Greene, et al., Protective Groups in Organic Synthesis, John Wiley and Sons, Second Edition, 1991, hereby incorporated by reference. When the alkyl group is said to be substituted with an alkyl group, this is used interchangeably with "branched alkyl group."

The term "alkene" includes a straight, branched or cyclic hydrocarbon containing from 2 to 24 carbon atoms and at least one carbon to carbon double bond. Examples of alkenyl groups include ethenyl, propenyl, butenyl and cyclohexenyl.

"Alkoxy" includes $C_1$-$C_{18}$ alkyl-O—, with the alkyl group optionally substituted as described herein. In certain embodiments, the alkoxy group is a polyalkylene glycol group.

The term "alkylamino" or "arylamino" refers to an amino group that has one or two alkyl or aryl substituents, respectively.

"Aryl" refers to aromatic rings e.g., phenyl, substituted phenyl, biphenyl, and the like, as well as rings which are fused, e.g., naphthyl, phenanthrenyl and the like. An aryl group thus contains at least one ring having at least 6 atoms, with up to five such rings being present, containing up to 22 atoms therein, with alternating (resonating) double bonds between adjacent carbon atoms or suitable heteroatoms. The typical aryl groups are phenyl, naphthyl and phenanthrenyl. The term includes both substituted and unsubstituted moieties. The aryl group can be substituted with one or more moieties selected from the group consisting of bromo, chloro, fluoro, iodo, hydroxyl, amino, alkylamino, arylamino, alkoxy, aryloxy, nitro, cyano, sulfonic acid, sulfate, phosphonic acid, phosphate, or phosphonate, either unprotected, or protected as necessary, as known to those skilled in the art, for example, as taught in Greene, et al., Protective Groups in Organic Synthesis, John Wiley and Sons, Second Edition, 1991. Typical substituted aryls include phenyl and naphthyl.

The term "alkaryl" or "alkylaryl" refers to an alkyl group with an aryl substituent. The term "aralkyl" or "arylalkyl" refers to an aryl group with an alkyl substituent.

The term "heteroaryl" or "heteroaromatic", as used herein, refers to an aromatic group that includes at least one sulfur, oxygen, nitrogen or phosphorus in the aromatic ring. Heteroaryl or heteroaromatic compounds include monocyclic aromatic hydrocarbon group having 5 or 6 ring atoms, or a bicyclic aromatic group having 8 to 10 atoms, containing at least one heteroatom, O, S or N, in which a carbon or nitrogen atom is the point of attachment, and in which one, two or three additional carbon atoms are optionally replaced by a heteroatom selected from oxygen, sulfur or nitrogen heteroatom. Examples of this type are pyrrole, pyridine, oxazole, thiazole and oxazine. Additional nitrogen atoms may be present together with the first nitrogen and oxygen or sulfur, giving, e.g., thiadiazole. The heteroaryl or heteroaromatic group can be optionally substituted with one or more substituent selected from halogen, haloalkyl, alkyl, alkoxy, hydroxy, carboxyl derivatives, amido, amino, alkylamino, dialkylamino. Functional oxygen and nitrogen groups on the heterocyclic or heteroaryl group can be protected as necessary or desired. Suitable protecting groups are well known to those skilled in the art, and include trimethylsilyl, dimethylhexylsilyl, t-butyldimethylsilyl, and t-butyl-diphenylsilyl, trityl or substituted trityl, alkyl groups, acyl groups such as acetyl and propionyl, methanesulfonyl, and p-toluenylsulfonyl.

The term "heterocycloalkyl" refers to a cycloalkyl group (nonaromatic) in which one of the carbon atoms in the ring is replaced by a heteroatom selected from O, S or N, and in which up to three additional carbon atoms may be replaced by heteroatoms.

The term "heteroatom" refers to oxygen, sulfur, nitrogen, and phosphorus selected on an independent basis.

Halogen and "halo," as used herein, includes bromine, chlorine, fluorine and iodine.

The term acyl refers to a carboxylic acid ester in which the non-carbonyl moiety of the ester group is selected from straight, branched, or cyclic alkyl, alkoxyalkyl including methoxymethyl, aralkyl including benzyl, aryloxyalkyl such as phenoxymethyl, aryl including phenyl optionally substituted with halogen, $C_1$ to $C_{24}$ alkyl or $C_1$ to $C_{18}$ alkoxy, sulfonate esters such as alkyl or aralkyl sulphonyl including methanesulfonyl, the mono, di or triphosphate ester, trityl or monomethoxytrityl, substituted benzyl, trialkylsilyl (e.g. dimethyl-t-butylsilyl) or diphenylmethylsilyl. Aryl groups in the esters typically include a phenyl group.

When a group is termed "substituted," unless otherwise indicated, this means that the group contains from 1 to 4 substituents thereon.

Applicant reserves the right to proviso out or exclude any individual members of any such group of values or ranges, including any sub-ranges or combinations of sub-ranges within the group, that can be claimed according to a range or in any similar manner, if for any reason Applicant chooses to claim less than the full measure of the disclosure, for example, to account for a reference that Applicant may be unaware of at the time of the filing of the application. Further, Applicant reserves the right to proviso out or exclude any members of a claimed group.

Although any methods and materials similar or equivalent to those described herein can be used in the practice or testing of the invention, the typical methods and materials are herein described.

A II publications and patents mentioned herein are incorporated herein by reference for the purpose of describing and disclosing, for example, the constructs and methodologies that are described in the publications, which might be used in connection with the presently described invention. The publications discussed throughout the text are provided solely for their disclosure prior to the filing date of the present application. Nothing herein is to be construed as an admission that the inventors are not entitled to antedate such disclosure by virtue of prior invention.

DETAILED DESCRIPTION

It is to be understood that the disclosure is not limited in its application to the details of construction and the arrangement of components set forth in the following description or illustrated in the drawings.

The methods and apparatus described herein improve upon the disclosures of U.S. Pat. Nos. 8,783,358 and 8,820,412, which describe methods, systems, and apparatus for circulating corrosion inhibiting fluid within the annulus of a flexible pipe riser. There are numerous factors that can affect the corrosion rate of components within a flexible pipe riser or similar pipe. The embodiments described herein provide example passivating agents that can be used in corrosion inhibiting fluids. Accordingly, it should be understood that the example passivating agents provided in this disclosure can be applied in combination with the embodiments provided in U.S. Pat. Nos. 8,783,358 and 8,820,412 both of which are incorporated herein by reference in their entirety.

According to methods and apparatuses of the present disclosure, which utilize passivating agents described herein, the incidence of corrosion of armor wires and other steel elements (e.g., pressure armor layers) within the annulus of flexible pipe, such as those used in flexible pipe risers in offshore hydrocarbon production facilities or in subsea operations under aqueous acidic environments, can be reduced. In particular, corrosion of the armor wires and related problems such as corrosion fatigue can be reduced by circulating a fluid comprising passivating agents within the annulus so that the fluid flows in the interstices between the armor wires and other steel elements. When circulated through the annulus of a flexible pipe, the passivating agents form protective layers on the metal surfaces of the flexible pipe. As an alternative to circulation, in other embodiments within the scope of this disclosure, the annulus of the flexible pipe can be filled (pre-charged) with the passivating agents, such as during manufacture or before installation of the flexible pipe, and the passivating agents can remain within the annulus until circulation is performed at a later time. In either the circulation approach or the pre-charge approach, the protective layers of the passivating agents repel polar aqueous fluids, thereby inhibiting or preventing corrosion of the protected metal surfaces. In particular, corrosion of metal surfaces caused by acidic substances (e.g., dissolved carbon dioxide or hydrogen sulfide) can be prevented by treating the metal surfaces with the passivating agents described herein.

The fluid comprising the passivating agents is referred to interchangeably herein as "fluid", "buffer fluid," or "flushing fluid." The buffer fluid can be circulated either continuously or intermittently within the annulus of a pipe. Alternatively, as explained in the preceding paragraph, the buffer fluid containing the passivating agents can be used to pre-charge the annulus of the pipe where it remains until it is circulated at a later time. The buffer fluid contacts and encompasses the armor wires and other metal elements, protecting them from corrosion. In certain embodiments, the metal is carbon steel or low alloy steel.

Carrier Fluids and Additives

The buffer fluid may consist of only one or more passivating agents, or may include one or more carriers, to form a layer which repels polar aqueous fluids. Any suitable carrier, i.e., a carrier fluid, which facilitates contact of the passivating agent with the metal surfaces of the flexible pipe and does not inhibit deposition of the passivating agent on the metal surface (i.e., formation of the protective layer on the metal surface) can be used.

In certain embodiments, the one or more carriers comprise about 1% to about 50%, or about 1% to about 20%, by volume of the buffer fluid. In certain embodiments, the buffer fluid comprises less than about 20%, or less than about 10%, of the one or more carriers. In certain embodiments, the buffer fluid does not comprise a carrier.

In certain embodiments, the buffer fluid can comprise viscosity modifying agents. In certain embodiments, the buffer fluid may comprise agents which enhance temperature tolerance of the buffer fluid.

As described further below, in certain embodiments, the buffer fluid can comprise one or more corrosion inhibitors in combination with the passivating agents described below. Examples of corrosion inhibitors include, but are not limited to, molybdates, organic nitrates, carbonates, silicates, phosphates and organic molecules containing heteroatoms such as nitrogen, sulfur, phosphorus and oxygen (e.g., materials such as anthranilic acid, thiols, organic phosphonates and organic carboxylates).

Passivating Agents

The following discussion provides the following three examples of passivating agents that may be included in the buffer fluid used to inhibit corrosion within a pipe: a) polybutene compounds, b) polyalphaolefin compounds, and c) polysiloxane compounds. In certain embodiments, two or more of these example passivating agents may be combined in the buffer fluid. Furthermore, embodiments of buffer fluids may include these example passivating agents in conjunction with other compounds, such as corrosion inhibitors, hydrophobic compounds, and hydrophilic compounds.

In certain embodiments, the passivating agents described herein are stable at temperatures up to about 150° F., or about 200° F.

In certain embodiments, the passivating agents are stable at low pH.

In certain embodiments, the passivating agents have a viscosity that allows the passivating agent to flow within the flexible pipe apparatus as described below.

Polybutene Compounds

In one example embodiment of the buffer fluid, the passivating agent comprises polybutene. The passivating agent may be polybutene alone or may be a mixture comprising polybutene. As defined above, polybutene is an olefinic polymer formed from butene monomers, wherein the butene monomers comprise 1-butene, 2-butene, and isobutylene. Polybutene typically is produced from a stream that is rich in isobutene so that typically the majority of the polybutene molecule is based upon isobutene.

The characteristics of polybutene offer advantages as a passivating agent in a flexible pipe apparatus. Polybutene can be pumped through a flexible pipe apparatus in a liquid state and is hydrophobic and tends to adhere to surfaces that are to be protected from corrosion. Certain varieties of polybutene have a relatively low viscosity facilitating the pumping of the polybutene though narrow spaces within a flexible pipe apparatus so that it can adhere to the surfaces that are to be protected from corrosion.

As one example, the polybutene used as a passivating agent can have a kinematic viscosity of 3 to 17 cSt at 100 degrees C., or 5 to 11 cSt at 100 degrees C., or 5 cSt at 100 degrees C., as measured using ASTM D445.

As another example, the polybutene used as a passivating agent can have a molecular weight of 350 to 510 Daltons, or 350 to 460 Daltons, or 350 Daltons, as measured by gel permeation chromatography (GPC).

As yet another example, the polybutene used as a passivating agent can have a pour point of −55 to −30 degrees C., or −45 to −35 degrees C., or −45 degrees C., as measured using ASTM D97.

As non-limiting examples, a variety of polybutenes are offered by Soltex, Inc. of The Woodlands, Texas. Soltex's PB 6 product has a molecular weight of 350 Daltons (GPC), a kinematic viscosity of 5 cSt at 100 degrees C. (ASTM D445), and a pour point of −45 degrees C. (ASTM D97). In another example, Soltex's PB 8 product has a molecular weight of 460 Daltons (GPC), a kinematic viscosity of 11 cSt at 100 degrees C. (ASTM D445), and a pour point of −35 degrees C. (ASTM D97). In yet another example, Soltex's PB 10 product has a molecular weight of 510 Daltons (GPC), a kinematic viscosity of 17 cSt at 100 degrees C. (ASTM D445), and a pour point of −30 degrees C. (ASTM D97).

In another example based upon the foregoing embodiment, the buffer fluid comprises a combination of polybutene with a corrosion inhibitor. As non-limiting examples, the corrosion inhibitor can be any of the example corrosion inhibitors described herein. As described further below in connection with the discussion of the test results illustrated in FIGS. 8A, 8B, and 13A-13B, an alkenylsuccinic acid-based corrosion inhibitor in combination with polybutene was found to be effective as a buffer fluid inhibiting corrosion. In the example test results of FIGS. 8A, 8B, and 13A-13B, the alkenylsuccinic acid-based corrosion inhibitor is a commercially available corrosion inhibitor blend known as OLOA® 4413. OLOA® 4413 comprises dodecenylsuccinic acid, polypropylene glycol, and alkoxylated alkylphenol. As an example, OLOA® 4413 is available from Zhengzhou Chorus Lubricant Additive Co., Ltd.

Polyalphaolefin Compounds

In another example embodiment of the buffer fluid, the passivating agent comprises a polyalphaolefin formed using $C_6$-$C_{12}$ alkene. The polyalphaolefin passivating agent will have a relatively low viscosity to facilitate pumping the agent through narrow spaces within a flexible pipe apparatus so that it can adhere to the surfaces that are to be protected from corrosion. As an example, the polyalphaolefin used as a passivating agent can have a kinematic viscosity of 1.5 to 10 cSt at 100 degrees C., or 4 to 8 cSt at 100 degrees C., or 4.1 cSt at 100 degrees C., as measured using ASTM D445.

Preferably, the polyalphaolefin passivating agent will have a relatively low pour point to facilitate use in cold water environments. As examples, the polyalphaolefin passivating agent can have a pour point of −73 to −30 degrees C., or −68 to −60 degrees C., or −66 degrees C., as measured using ASTM D97.

As described further below in connection with the discussion of the test results illustrated in FIGS. 7A-7B, a commercially available polyalphaolefin compound that is a synthetic lubricant known as SPECTRASYN 4 from EXXONMOBIL has been shown to be particularly effective at reducing corrosion. SPECTRASYN 4 has a kinematic viscosity of 4.1 cSt at 100 degrees C., as measured using ASTM D445, and a pour point of −66 degrees C., as measured using ASTM D97.

In another example based upon the foregoing embodiment, the buffer fluid comprises a combination of polyalphaolefin with a corrosion inhibitor. As non-limiting examples, the corrosion inhibitor can be any of the example corrosion inhibitors described herein. As described further below in connection with the discussion of the test results illustrated in FIGS. 14A-16B, an alkenylsuccinic acid-based corrosion inhibitor in combination with polyalphaolefin was found to be effective as a buffer fluid inhibiting corrosion. In the example test results of FIGS. 14A-16B, the alkenylsuccinic acid-based is the previously described commercially available corrosion inhibitor known as OLOA® 4413.

Polysiloxane Compounds

Another example embodiment of passivating agents that may be used in a buffer fluid includes polysiloxane compounds, such as alkyl-substituted polysiloxane compounds. In certain embodiments, the passivating agent is a compound of Formula I:

Formula I

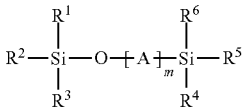

wherein each

[A]

is the same or different and is a divalent unit represented by the structure:

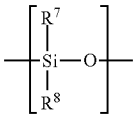

wherein $R^7$ is $C_1$ to $C_{18}$ alkyl or $C_6$ to $C_{22}$ aryl, optionally substituted by one or more hydroxy, alkoxy, carboxy, amino, aryl, heteroaryl, or polyether groups, or any combination, and in some embodiments is substituted by a $C_2$ or $C_3$ alkylene oxide chain having between 1 and 25 repeating units, such as between 2 and 20 repeating units, between 4 and 16 repeating units, or between 6 and 9 repeating units; $R^8$ is $C_1$ to $C_{24}$ alkyl or $C_6$ to $C_{22}$ aryl, optionally substituted by one or more hydroxy, alkoxy, carboxy, amino, aryl, heteroaryl, or polyether groups, or any combination thereof, and in some embodiments is substituted by a $C_2$ or $C_3$ alkylene oxide chain having between 1 and 25 repeating units, such as between 2 and 20 repeating units, between 4 and 16 repeating units, or between 6 and 9 repeating units, m is an integer greater than or equal to 1; $R^1$, $R^2$, $R^3$, $R^4$, $R^5$ and $R^6$ are independently selected from $C_1$ to $C_6$ alkyl or $C_6$ to $C_{22}$ aryl; and optionally, one or more of $R^1$, $R^2$, $R^3$, $R^4$, $R^5$, $R^6$, $R^7$ and $R^8$ are substituted with phosphonic acid (—P(=O)(OH)$_2$)) or phosphonate (—P(=O)(OR$^9$)$_2$ wherein $R^9$ is $C_1$ to $C_6$ alkyl or $C_6$ to $C_{22}$ aryl).

Generally, the divalent unit each

[A]

may be different. In certain embodiments, two or more types of

[A]

may alternate in series (e.g., as discrete blocks or as mixed blocks). The number of types of divalent units

[A]

is not particularly limited, and the passivating agent may include one, two, three, four, or more types. In certain embodiments, two or more types of

[A]

may be randomly arranged in series or may be arranged in blocks. In certain embodiments, two or more types of

[A]

may be arranged in blocks of 2 or more units of the same type connected in series.

In certain embodiments, m (the number of divalent units

[A]

) is an integer in the range of 1 to 200.

In certain embodiments, two types of

[A]

may alternate in series or in blocks and may be a copolymer, such as a block copolymer. For instance, a first

[A]

may include a first set of $R^7$ and $R^8$ ($R^{7'}$ and $R^{8'}$, respectively) and a second

[A]

may include a second, independent set of $R^7$ and $R^8$ ($R^{7''}$ and $R^{8''}$, respectively), as shown below:

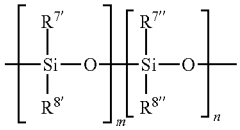

wherein $R^{7'}$ is $C_1$ to $C_{18}$ alkyl or $C_6$ to $C_{22}$ aryl, optionally substituted by one or more hydroxy, alkoxy, carboxy, amino, aryl, heteroaryl, or polyether groups, or any combination thereof, and in some embodiments is substituted by a $C_2$ or $C_3$ alkylene oxide chain having between 1 and 25 repeating units, such as between 2 and 20 repeating units, between 4 and 16 repeating units, or between 6 and 9 repeating units; $R^{8'}$ is $C_1$ to $C_{24}$ alkyl or $C_6$ to $C_{22}$ aryl, optionally substituted by one or more hydroxy, alkoxy, carboxy, amino, aryl, heteroaryl, or polyether groups, or any combination thereof, and in some embodiments includes a $C_2$ or $C_3$ alkylene oxide chain having between 1 and 25 repeating units, such as between 2 and 20 repeating units, between 4 and 16 repeating units, or between 6 and 9 repeating units; $R^{7''}$ is $C_1$ to $C_{18}$ alkyl or $C_6$ to $C_{22}$ aryl, optionally substituted by one or more hydroxy, alkoxy, carboxy, amino, aryl, heteroaryl, or polyether groups, or any combination thereof, and in some embodiments is substituted by a $C_2$ or $C_3$ alkylene oxide chain having between 1 and 25 repeating units, such as between 2 and 20 repeating units, between 4 and 16 repeating units, or between 6 and 9 repeating units; and $R^{8''}$ is $C_1$ to $C_{24}$ alkyl or $C_6$ to $C_{22}$ aryl, optionally substituted by one or more hydroxy, alkoxy, carboxy, amino, aryl, heteroaryl, or polyether groups, or any combination thereof, and in some embodiments includes a $C_2$ or $C_3$ alkylene oxide chain having between 1 and 25 repeating units, such as between 2 and 20 repeating units, between 4 and 16 repeating units, or between 6 and 9 repeating units, and wherein m is an integer between 1 and 100, and n is an integer between 1 and 100.

In still further embodiments, three types of

[A]

may alternate in series or in blocks, as shown below:

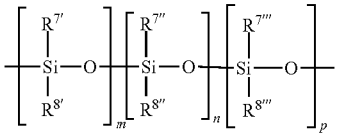

wherein the first

[A]

may be as set forth above, i.e., include a first set of $R^7$ and $R^8$ ($R^{7'}$ and $R^{8'}$, respectively) and the second

[A]

may be as set forth above, i.e., include a second, independent set of $R^7$ and $R^8$ ($R^{7''}$ and $R^{8''}$, respectively), and a third

[A]

may include a third, independent set of $R^7$ and $R^8$ ($R^{7'''}$ and $R^{8'''}$, respectively) wherein $R^{7'''}$ is $C_1$ to $C_{18}$ alkyl or $C_6$ to $C_{22}$ aryl, optionally substituted by one or more hydroxy, alkoxy, carboxy, amino, aryl, heteroaryl, or polyether groups, or any combination thereof, and in some embodiments includes a $C_2$ or $C_3$ alkylene oxide chain having between 1 and 25 repeating units, such as between 2 and 20 repeating units, between 4 and 16 repeating units, or between 6 and 9 repeating units; and $R^{8'''}$ is $C_1$ to $C_{24}$ alkyl or $C_6$ to $C_{22}$ aryl, optionally substituted by one or more hydroxy, alkoxy, carboxy, amino, aryl, or heteroaryl groups, and in some embodiments is substituted by a $C_2$ or $C_3$ alkylene oxide chain having between 1 and 25 repeating units, such as between 2 and 20 repeating units, between 4 and 16 repeating units, or between 6 and 9 repeating units, and wherein m, n, and p are independently integers of 1 or more.

Referring again to Formula I, in certain embodiments $R^1$, $R^2$, $R^3$, $R^4$, $R^5$ and $R^6$ are methyl. In certain embodiments, one or more of $R^1$, $R^2$, $R^3$, $R^4$, $R^5$ and $R^6$ are substituted with phosphonic acid (—P(=O)$(OH)_2$).

In certain embodiments, $R^7$ is methyl. In certain embodiments, $R^7$ is $C_1$ to $C_{18}$ unsubstituted alkyl, for example, butyl, pentyl, hexyl, heptyl, octyl, nonyl, decyl, undecyl, dodecyl, tridecyl, tetradecyl, pentadecyl, hexadecyl, heptadecyl, or octadecyl. In certain embodiments, $R^7$ is $C_1$ to $C_{18}$ alkyl substituted by one or more hydroxy groups. In certain embodiments, $R^7$ is $C_1$ to $C_{18}$ alkyl substituted by one or more alkoxy groups ("alkoxy" refers to $C_1$-$C_6$—O— groups). In certain embodiments, $R^7$ is $C_1$ to $C_{18}$ alkyl substituted by one or more carboxy groups. In certain embodiments, $R^7$ is $C_1$ to $C_{18}$ alkyl substituted by one or more amino groups ("amino" refers to —NRR', where R and R' are each selected from H or $C_1$-$C_4$ alkyl). In certain embodiments, $R^7$ is $C_1$ to $C_{18}$ alkyl substituted by one or more aryl groups (e.g., phenyl substituted alkyl). In certain embodiments, $R^7$ is $C_1$ to $C_{18}$ alkyl substituted by one or more heteroaryl groups (e.g., thiophenyl-, furanyl-, or pyridyl-substituted alkyl). In certain embodiments, $R^7$ is $C_1$ to $C_{18}$ alkyl substituted by one or more polyether groups (e.g., polyethylene glycol-, polypropylene glycol-substituted alkyl).

In certain embodiments, the compound of Formula I comprises at least 2, at least 3, at least 4, at least 5, or at least 6 different $R^7$ groups.

In certain embodiments, $R^8$ is $C_2$ to $C_{18}$ unsubstituted alkyl, for example, butyl, pentyl, hexyl, heptyl, octyl, nonyl, decyl, undecyl, dodecyl, tridecyl, tetradecyl, pentadecyl, hexadecyl, heptadecyl, or octadecyl. In certain embodiments, $R^8$ is $C_2$ to $C_{18}$ alkyl substituted by one or more hydroxy groups. In certain embodiments, $R^8$ is $C_2$ to $C_{18}$ alkyl substituted by one or more alkoxy groups. In certain embodiments, $R^8$ is $C_2$ to $C_{18}$ alkyl substituted by one or more carboxy groups. In certain embodiments, $R^8$ is $C_2$ to $C_{18}$ alkyl substituted by one or more amino groups. In certain embodiments, $R^8$ is $C_2$ to $C_{18}$ alkyl substituted by one or more aryl groups. In certain embodiments, $R^8$ is $C_2$ to $C_{18}$ alkyl substituted by one or more heteroaryl groups. In certain embodiments, $R^8$ is $C_2$ to $C_{18}$ alkyl substituted by one or more polyether groups.

In certain embodiments, $R^8$ is $C_8$ to $C_{14}$ alkyl, optionally substituted by one or more hydroxy, alkoxy, carboxy, amino, aryl, heteroaryl, or polyether groups, or any combination thereof.

In certain embodiments, the compound of Formula I comprises at least 2, at least 3, at least 4, at least 5, or at least 6 different $R^8$ groups.

In one example embodiment, the first and second

[A]

may be different, and the passivating agent may be a PDMS polymer, such as dimethylsiloxane-ethylene oxide copolymer as set forth below:

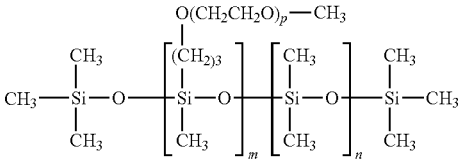

wherein m and n are independently integers of 1 or more, and wherein p is an integer of between 1 and 25, such as between 2 and 20, between 4 and 16, or between 6 and 9.

In another example embodiment, the first, second, and third

[A]

may be as set forth below:

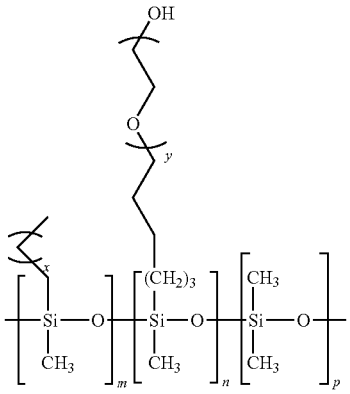

wherein m, n, and p are independently integers of 1 or more, wherein x is an integer of between 2 and 20, such as between 4 and 16, for example 8, 10, or 12, and wherein y is an integer of between 1 and 25, such as between 2 and 20, between 4 and 16, or between 6 and 9.

In one embodiment, the passivating agent may be an alkylmethylsiloxane-hydroxy(polyalkyleneoxypropyl) methylsiloxane-dimethylsiloxane terpolymer, such as (dodecylmethylsiloxane)-(hydroxy(polyethyleneoxypropyl) methylsiloxane)-dimethylsiloxane terpolymer.

Passivating agents that are alkyl-substituted polysiloxane compounds for use in the methods and apparatuses described herein can be prepared by any known methods. For example, the passivating agents can be prepared by transition metal-catalyzed hydrosilylation of polymethylhydrosiloxane with an alkene or functionalized alkene (see Scheme 1).

Scheme 1. Hydrosilylation of polymethylhydrosiloxane with an alkene or functionalized alkene.

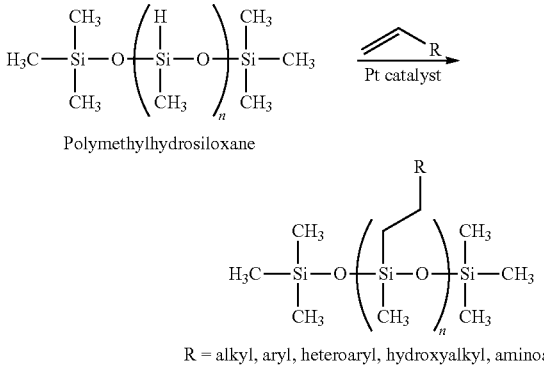

Polymethylhydrosiloxane is available, for example, from Gelest, Inc. (Morrisville, PA).

The hydrosilylation catalysts may be any hydrosilylation catalyst known in the art. Examples of the catalyst for the hydrosilylation reaction include a simple substance of group 8 element to group 10 element metal such as cobalt, nickel, ruthenium, rhodium, palladium, iridium and platinum; an organic metallic complex thereof; a metallic salt thereof; a metallic oxide thereof; and the like. Typically, a platinum-based catalyst is used. Examples of the platinum-based catalyst include cis-$PtCl_2(PhCN)_2$, platinum carbon, platinum complex (Pt(dvs)) in which 1,3-divinyltetramethyldisiloxane is coordinated, platinum vinyl methyl ring siloxane complex, platinum carbonyl-vinyl methyl ring siloxane complex, tris(dibenzylideneacetone)diplatinum, chloroplatinic acid, bis ethylene)tetrachloro diplatinum, cyclooctadiene dichloro platinum, bis(cyclooctadiene)platinum, bis(dimethylphenylphosphine)dichloro platinum, tetrakis (triphenylphosphine)platinum, and the like. Platinum complex (Pt(dvs)) in which 1,3-divinyltetramethyldisiloxane is coordinated, platinum vinyl methyl ring siloxane complex, and platinum carbonyl-vinyl methyl ring siloxane complex are particularly preferable among them. "Ph" is a phenyl group. The amount of the catalyst used is preferably in the range from 0.1 ppm to 1,000 ppm by weight, more preferably from 0.5 ppm to 100 ppm by weight, and further preferably from 1 ppm to 10 ppm by weight based on the amount of the polysiloxane.

In certain embodiments, the transition metal catalyst is a platinum-based catalyst.

Alternatively, other methylhydrosiloxane copolymers can be used in place of polymethylhydrosiloxane, including but not limited to methylhydrosiloxane-dimethylsiloxane copolymer (see example Scheme 2) and methylhydrosiloxane-phenylmethylsiloxane copolymer (see example Scheme 3).

Scheme 2. Hydrosilylation of methylhydrosiloxane-dimethylsiloxane copolymer with an alkene or functionalized alkene.

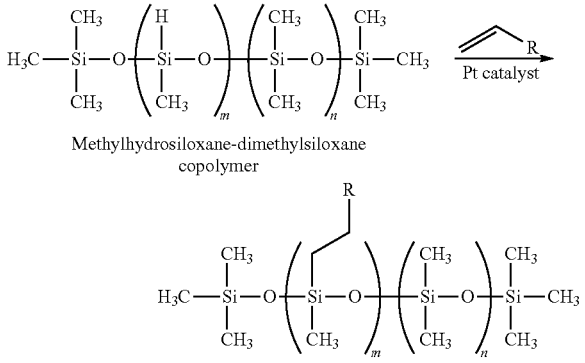

Scheme 3. Hydrosilation of methylhydrosiloxane-phenylmethylsiloxane copolymer with an alkene or functionalized alkene.

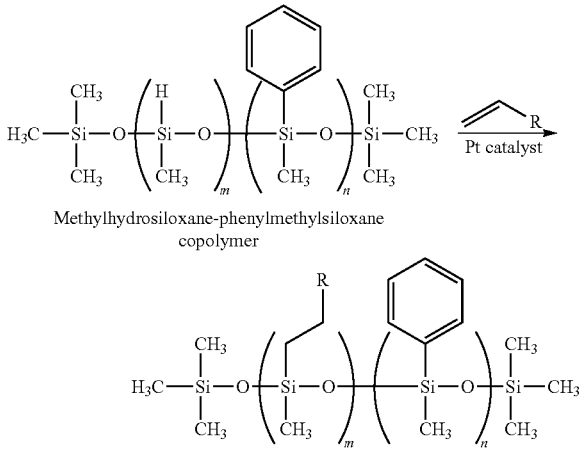

Methylhydrosiloxane-dimethylsiloxane copolymer and methylhydrosiloxane-phenylmethylsiloxane copolymer are each available, for example, from Gelest, Inc. (Morrisville, PA).

Generally, when two or more types of alkenes or functionalized alkenes are used in the hydrosilylation reaction, the substituted siloxane groups may alternate in series, be randomly arranged in series, and/or be arranged in blocks of 2 or more units of the same type connected in series. The timing of addition of reagents and reaction kinetics may determine the order and arrangement of the groups.

Such reactions may produce compounds having the one, two, three, or more types of divalent units

[A]

previously described. A gain, and with reference to Schemes 2 and 3, "m" and "n" may indicate the number of the units in the polysiloxane copolymer but are not limited to copolymers with only one "m" block of one type of siloxane unit and only one "n" block of one type of siloxane unit. The arrangement or connectivity of the different siloxane units in the series (i.e., chain) is not limited.

In the hydrosilylation reactions, not all of the Si—H bonds will be replaced. In certain embodiments, about 1, about 2, about 5, about 10, about 20 or about 30% of the Si—H bonds will remain unreacted in the passivating agents (i.e., final polysiloxane products of the reaction).

In certain embodiments, the passivating agent is the reaction product of a transition metal-catalyzed hydrosilylation of polymethylhydrosiloxane with an alkene or functionalized alkene (e.g., aryl-substituted alkene, heteroaryl-substituted alkene or heteroatom-functionalized alkene).

In certain embodiments, the alkene is an alpha-olefin, for example 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, and other higher alpha-olefins.

In certain embodiments, the alkene is an aryl-substituted alkene, for example, styrene, substituted styrenes, allylbenzene, 4-phenyl-1-butene, 5-phenyl-1-pentene, 6-phenyl-1-hexene and the like, including regioisomers where the phenyl ring is substituted at different positions of the alkyl chain.

In certain embodiments, the alkene is a heteroaryl-substituted alkene, for example, vinylthiophene, vinylfuran, vinylpyridine, allyl thiophene, allyl furan, allyl pyridine, and the like.

In certain embodiments, the alkene is a heteroatom-functionalized alkene, for example, allyl alcohol, homoallyl alcohol, hydroxyalkylamine, allylamine, homoallyl amine, alkyl acrylate, alkyl undecylenate, and the like.

The passivating agents may be used in the methods and apparatuses described herein as isolated compounds or as product mixtures comprising two or more compounds of Formula I.

In certain embodiments, the passivating agents may be a mixture of one or more polysiloxane compounds with hydrophobic and/or hydrophilic compounds.

Pretreatment of Flexible Pipe Apparatus

In certain example embodiments employing the passivating agents described herein, a pretreatment step can be performed before the passivating agent is introduced into the flexible pipe apparatus. Specifically, the surfaces of the flexible pipe apparatus can be pretreated with a pretreating corrosion inhibitor before introducing the passivating agent. The pretreating corrosion inhibitor can be introduced into the annulus of the flexible pipe apparatus in the same manner described herein for introducing the passivating agent. The pretreating corrosion inhibitor should be readily soluble so that it does not plug the annulus of the flexible pipe. In certain embodiments, the pretreating corrosion inhibitor may be combined with a carrier fluid, such as water or ethanol.

Examples of the pretreating corrosion inhibitor include, but are not limited to, molybdates, organic nitrates, carbonates, silicates, phosphates and organic molecules containing heteroatoms such as nitrogen, sulfur, phosphorus and oxygen (e.g., materials such as anthranilic acid, thiols, organic phosphonates and organic carboxylates).

As another example, the pretreating corrosion inhibitor may be a hydrophobic silane. One example of a hydrophobic silane that may be used as a pretreating corrosion inhibitor is isooctyltriethoxysilane. As described further below in connection with the discussion of the test results illustrated in FIGS. 7A-16B, pretreating with a solution comprising isooctyltriethoxysilane has been demonstrated to inhibit corrosion.

Flexible Pipe Apparatus

The passivating agents can be used to treat interior surfaces or annulus of flexible polymer pipe where armor wires are located. The passivating agents, when in contact with the metal (e.g., steel) surfaces of the armor wires, form a coating or protective layer, which prevents or inhibits corrosion of the metal surface. In one embodiment, an apparatus comprising a flexible pipe at least partially coated (i.e., passivated) with one or more passivating agents described herein is provided.

In one embodiment, a flexible pipe apparatus for use in a riser system in an offshore hydrocarbon production facility, comprises: a) a tubular carcass layer defining a bore therein for transporting produced well fluids; b) a pressure sheath surrounding the carcass layer; c) an external sheath surrounding the pressure sheath and defining an annulus therebetween; d) at least two layers of armor wires within the annulus; and e) at least one buffer fluid tube located within the annulus; wherein the at least one buffer fluid tube has at least one opening for introducing fluid to the annulus; wherein the surfaces of the pressure sheath and the external sheath in contact with the fluid passing through the annulus are at least partially coated with one or more passivating agents selected from compounds of Formula I as described above.

Another embodiment is directed to a flexible pipe apparatus for use in an offshore hydrocarbon production facility. The flexible pipe apparatus comprises: a) a tubular carcass layer defining a bore therein for transporting produced well fluids; b) a pressure sheath surrounding the carcass layer; c) an external sheath surrounding the pressure sheath and defining an annulus therebetween; and d) a plurality of tubes within the annulus and helically wound around at least the pressure sheath; wherein each of the plurality of tubes has at least one opening through which a buffer fluid comprising one or more passivating agents is introduced; and wherein surfaces of the pressure sheath and the external sheath in contact with the buffer fluid passing through the annulus are at least partially coated with the one or more passivating agents. In one example, the one or more passivating agents comprise a polysiloxane compound such as the example compounds described herein. In another embodiment, the one or more passivating agents comprise a polyalphaolefin. In yet another example, the one or more passivating agents comprise polybutene. In yet another example, the one or more passivating agents comprise one of the foregoing passivating agents in combination with a corrosion inhibitor.

In certain embodiments, the flexible pipe apparatus further comprises: f) a topsides end fitting attached to a topsides end of the flexible pipe apparatus, having an inlet port in fluid communication with the plurality of tubes within the annulus and an outlet port in fluid communication with the annulus; and g) a subsea end fitting attached to a subsea end of the flexible pipe apparatus.

In certain embodiments, the flexible pipe apparatus further comprises: a segregating wall separating the inlet port from the outlet port.

In certain embodiments, the buffer fluid tube is a component of at least one tape layer free of metal wires located within the annulus and helically wound around at least one layer within the annulus; wherein the at least one tape layer contains a plurality of buffer fluid tubes wherein each of the plurality of buffer fluid tubes has at least one opening for introducing fluid into the annulus.

In certain embodiments, the plurality of buffer fluid tubes have solid walls and openings at the ends thereof.

In certain embodiments, the plurality of buffer fluid tubes have perforated walls.

In certain embodiments, the at least one tape layer comprises two tape layers.

In one embodiment, a flexible pipe apparatus for use in a riser system in an offshore hydrocarbon production facility, comprises: a) a tubular carcass layer defining a bore therein for transporting produced well fluids; b) a pressure sheath surrounding the carcass layer; c) an external sheath surrounding the pressure sheath and defining an annulus therebetween; d) at least two layers of armor wires within the annulus; e) at least one buffer fluid tube located within the annulus and helically wound around at least one layer of the armor wires within the annulus; wherein the at least one buffer fluid tube has at least one opening for introducing fluid to the annulus; f) a topsides end fitting attached to a topsides end of the flexible pipe apparatus, having an inlet port in fluid communication with the plurality of tubes within the annulus and an outlet port in fluid communication with the annulus; g) a segregating wall separating the inlet port from the outlet port; and h) a subsea end fitting attached to a subsea end of the flexible pipe apparatus; wherein the surfaces of the pressure sheath and the external sheath in contact with the fluid passing through the annulus are at least partially coated with one or more passivating agents as described herein.

Exemplary flexible pipe apparatuses are illustrated by FIGS. 1-6.

In one example, the fluid comprising the passivating agents (i.e., buffer fluid) is circulated in a closed loop in the manner in which a buffer fluid would be circulated. In particular, the closed loop includes at least one buffer fluid tube and the annulus of the flexible pipe riser. According to the present disclosure, the buffer fluid is introduced into the annulus of the flexible pipe riser through at least one opening in at least one tube in the annulus, also referred to herein as the "buffer fluid tube." Referring to FIG. 1A, a system is illustrated according to one embodiment in which one end of a flexible pipe riser 10 is connected to a topside end fitting 12 at a production platform 1. The other end of the flexible pipe riser 10 terminates on the seabed 3 at a touchdown point where subsea end fitting 14 rests on the seabed 3. Subsea end fitting 14 is connected to an end fitting 15 of a flow line 60. Buffer fluid is stored in fluid storage tank 30 on the production platform 1. The fluid is taken from the tank 30, through conduit 36 and pumped by pump 32 into at least one buffer fluid tube (to be described in more detail hereinafter) in the annulus of flexible pipe riser 10. Once introduced into the annulus, the fluid flows in the interstices in the annulus. Fluid pressure drives the fluid within the annulus to rise through the annulus to return to the topsides end fitting 12 at the platform 1. Upon returning to the topsides end fitting 12, the fluid is directed to a port in the topsides end fitting in fluid communication with the tank 30 via conduit 31. The fluid is returned to the tank where contaminants can be removed from the fluid, and the fluid can be recirculated in the loop including the at least one buffer fluid tube and the annulus by pump 32. The fluid can be recirculated continuously or intermittently.

As referenced previously, as an alternative to circulating the fluid through the annulus of the pipe in a closed loop, the annulus of the pipe can be pre-charged with the fluid comprising the passivating agents during manufacture of the pipe or before installation of the pipe. Pre-charging the annulus with the fluid comprising the passivating agents can provide the added benefit of relieving stress on the armor layers as the pipe is installed in deep water.

FIG. 1B is a longitudinal cross-section of the flexible pipe riser 10 illustrating a side view of the annulus 40 surrounding bore 16 having produced well fluids containing hydrocarbons 38 flowing therethrough. The armor wires and other steel elements within the annulus are represented by 50. The buffer fluid, introduced into the annulus from the buffer fluid tube, flowing in the interstices in the annulus is represented by 34.

Figure 1D:
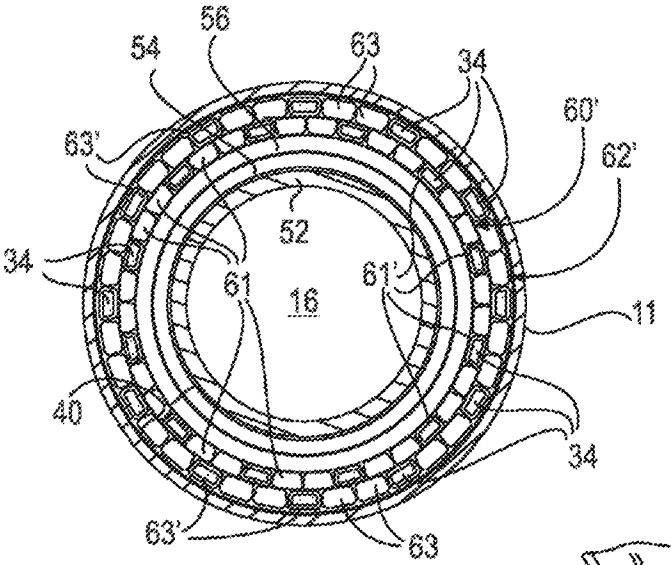
Figure 1E:
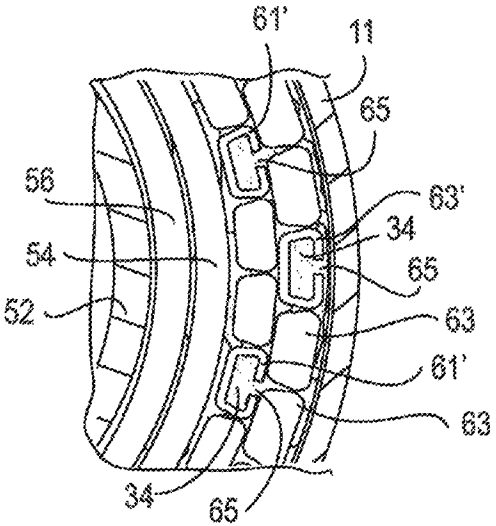
Figure 1C:
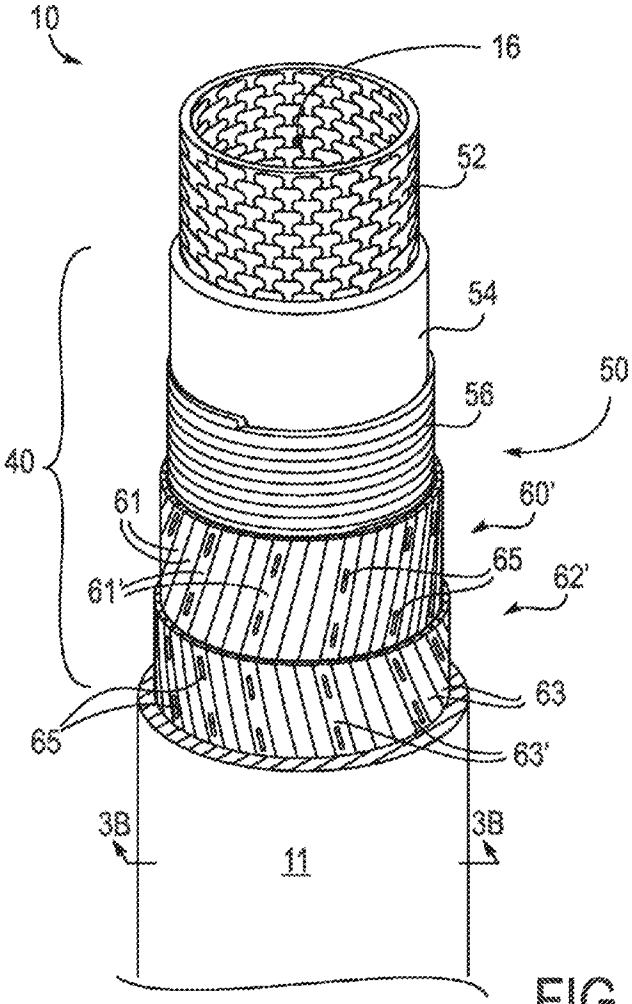

In one embodiment, at least one armor wire layer within the annulus includes at least one buffer fluid tube. In this case, the buffer fluid tube is embedded within the armor wire layer. The buffer fluid tube is generally similar in size and shape to an individual armor wire. FIG. 1C is an exploded view of a flexible pipe riser 10 showing each of the layers of the flexible pipe. Innermost is the bore 16 within and defined by the carcass 52. The carcass 52 is surrounded by pressure sheath 54 which is in turn surrounded by the annulus 40. The annulus 40 includes layers 50 which include pressure armor layer 56, inner tensile armor wire layer 60' and outer tensile armor wire layer 62'. In the embodiment illustrated, within inner tensile armor wire layer 60' are tensile armor wires 61 and buffer fluid tubes 61'. Buffer fluid tubes 61' have perforations 65 through which buffer fluid is introduced into the annulus. Similarly, within outer tensile armor wire layer 62' are tensile armor wires 63 and buffer fluid tubes 63' having perforations 65 through which buffer fluid 34 is introduced into the annulus. Surrounding the outer tensile armor wire layer is the external sheath 11. The cross-section of the flexible pipe is shown in FIG. 1D. FIG. 1E is an expanded view of the wall of the flexible pipe, showing each of the layers previously described as well as the interstitial spaces 90 there between. Within these spaces, buffer fluid 34 flows.

Figure 2D:
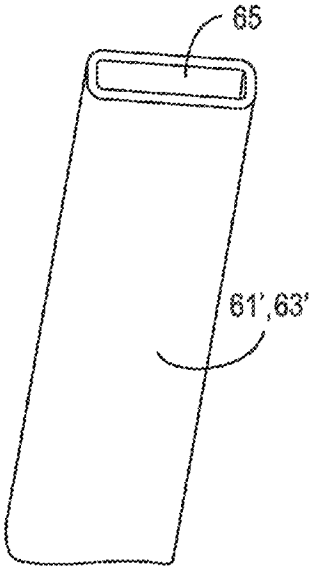
FIGS. 2A-2D illustrate example embodiments of apparatus for circulating fluid within the annulus of a flexible pipe riser.
Figure 2C:
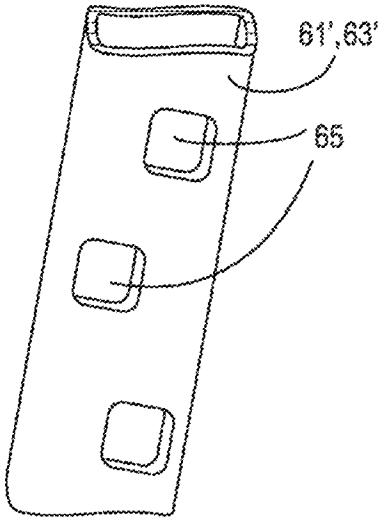
Figure 2B:
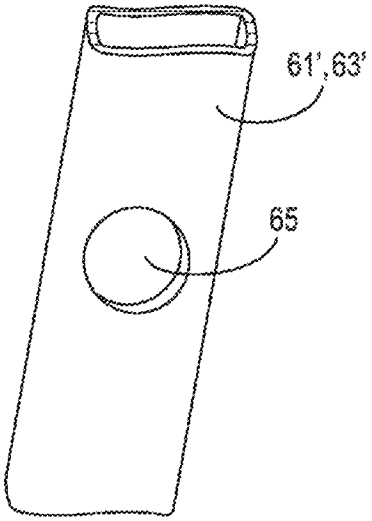
Figure 2A:
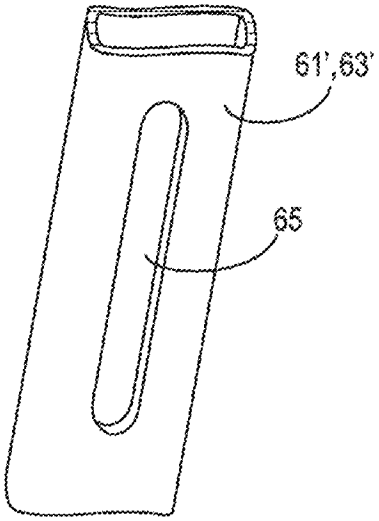
Figure 3:
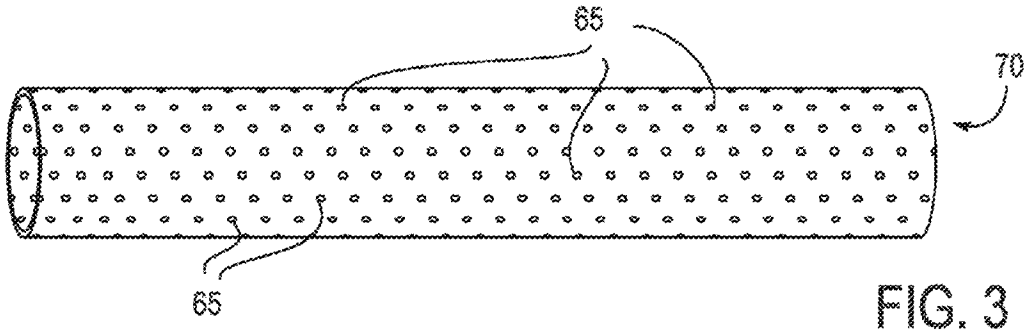
FIG. 3 illustrates an apparatus for circulating fluid within the annulus of a flexible pipe riser according to one embodiment.

FIGS. 2A-2D and FIG. 3 illustrate exemplary embodiments of the buffer fluid tube 61' or 63' having at least one opening therein for fluid to be introduced into the annulus. FIGS. 2A-2C illustrate buffer fluid tubes having one or more perforations 65 along the length thereof. FIG. 2D illustrates a buffer fluid tube having a solid wall, i.e., having no perforations. Such solid buffer fluid tubes have an opening 65 at one end thereof through which fluid can be introduced into the annulus. FIG. 3 illustrates a buffer fluid tube 70 according to another embodiment having many small perforations 65 along the length thereof through which buffer fluid is introduced into the annulus such that it weeps from the tube the entire length of the riser.

Figure 4A:
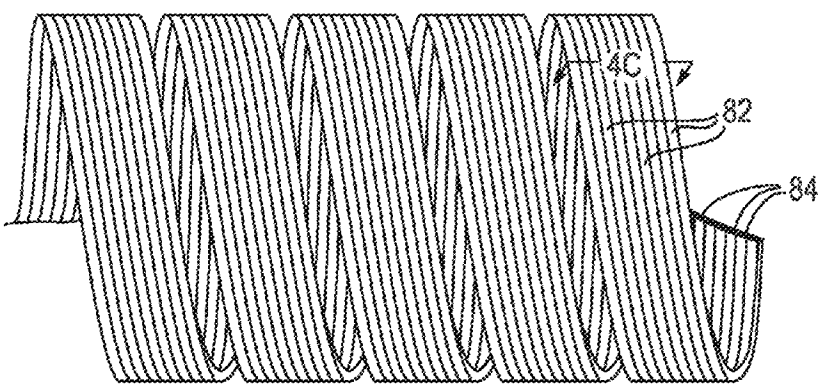
FIGS. 4A-4D illustrate example embodiments of apparatus for circulating fluid within the annulus of a flexible pipe riser.
Figure 4B:
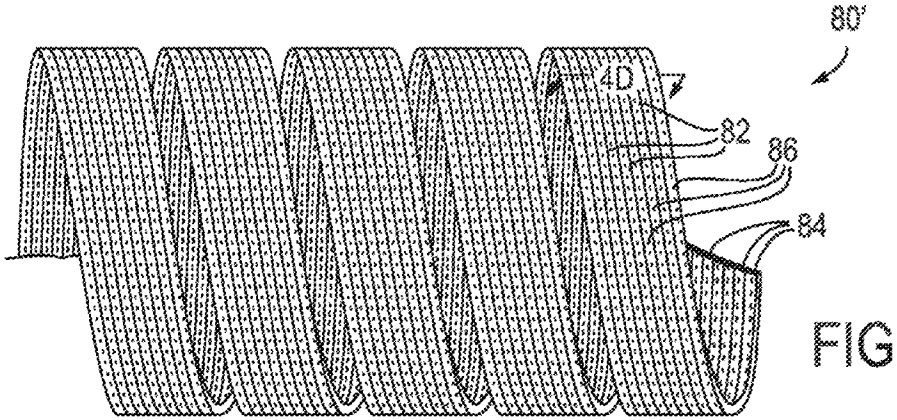
Figure 4C:
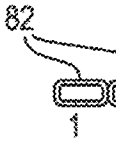
Figure 4D:
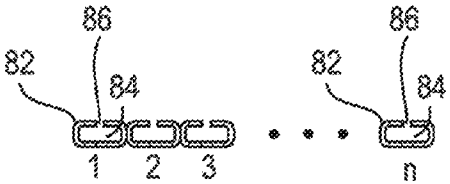

In an alternative embodiment, the buffer fluid can be provided to the annulus by a tape having at least one buffer fluid tube therein. In one embodiment, the tape can include a plurality of buffer fluid tubes in a side-by-side arrangement. Referring to FIG. 4A, tape 80 has a plurality of buffer fluid tubes 82 having openings 84 at the ends thereof. The tubes 82 are arranged side-by-side in a generally ribbon shaped tape. FIG. 4C is a cross-section of tape 80. As shown, the number of tubes 82 within the tape may vary. The number of tubes 82 can vary between two and n tubes, where n is any convenient number. For example, FIG. 4A illustrates a tape with nine tubes 82. Referring to FIG. 4B, tape 80' has a plurality of buffer fluid tubes 82 arranged side-by-side having openings 84 at the tube ends as well as perforations 86 along the length thereof. FIG. 4D is a cross-section of tape 80'. While in the cross-sectional views shown, all of the tubes are lined up in a straight row, they could have an alternative arrangement. For instance, the tubes could be staggered with respect to each other.

Figure 5B:
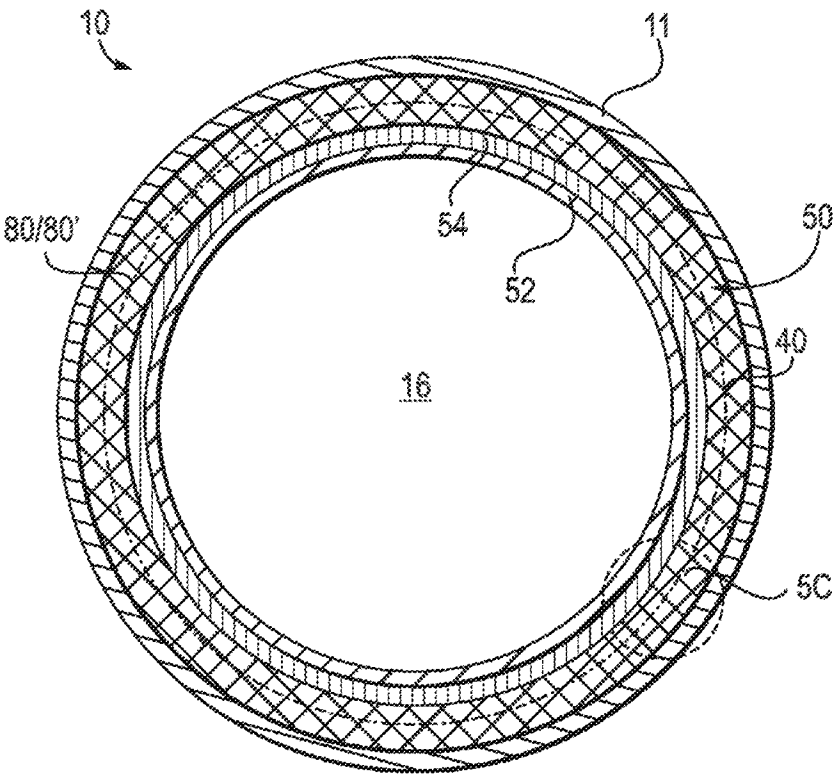
FIGS. 5A-5C illustrate a flexible pipe riser according to one embodiment.
Figure 5A:
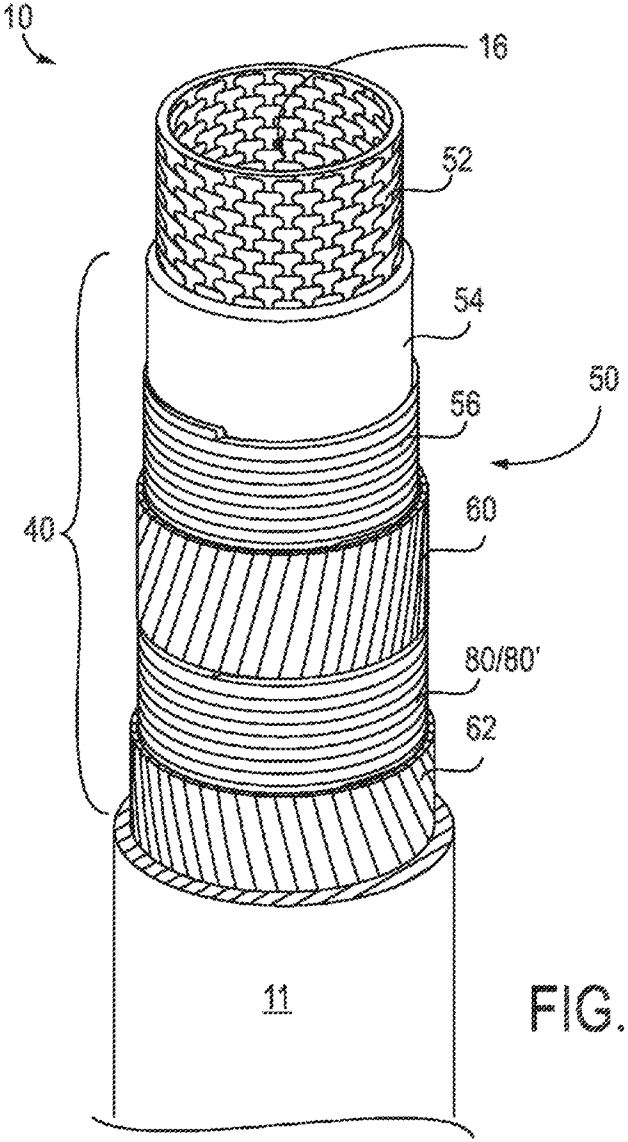
Figure 5C:
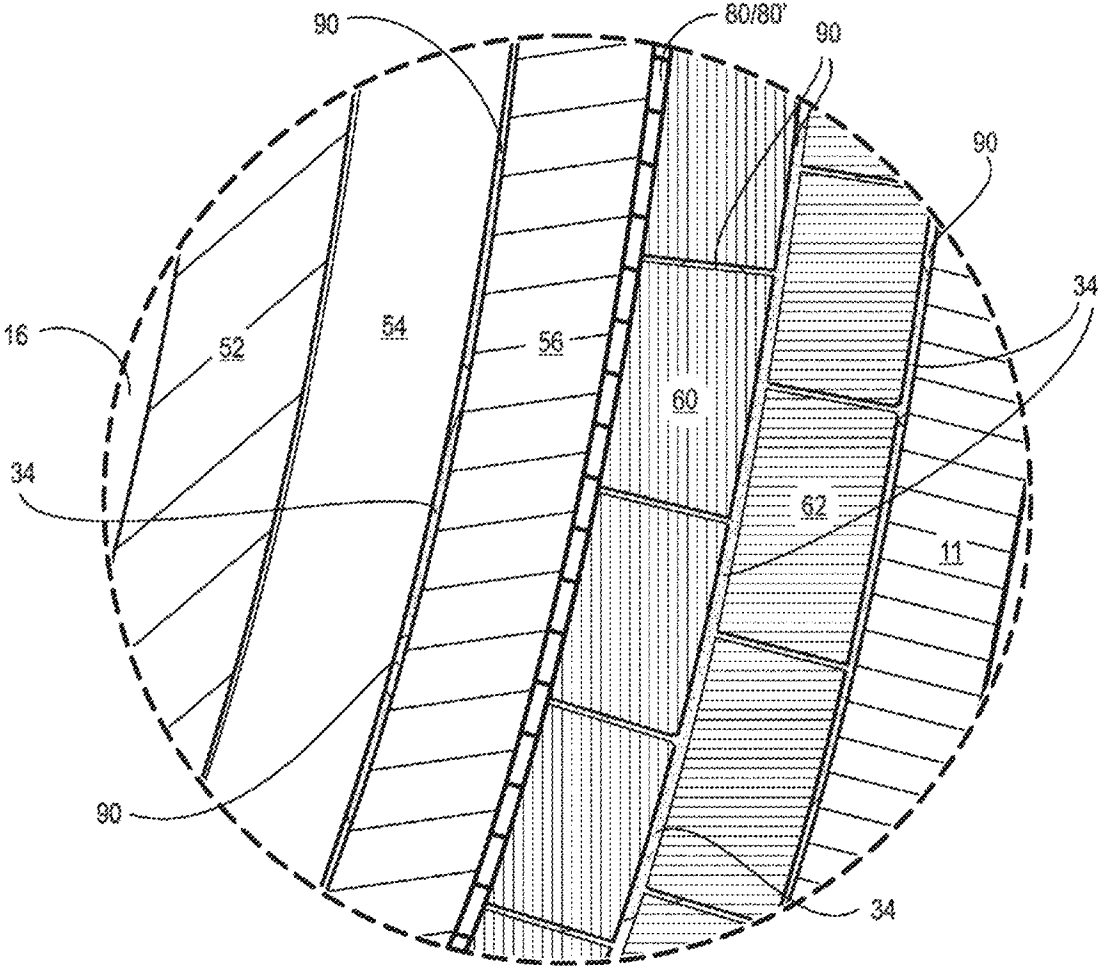

FIG. 5A is an exploded view of a riser 10 incorporating tape 80 or 80' (represented by 80/80') within the annulus 40. As shown, the tape 80/80' is helically wound between armor wire layers 60 and 62. FIG. 5B is a cross-section of riser 10, and FIG. 5C is a detailed view of the wall of riser 10. While the tape 80/80' is shown between the armor wire layers 60 and 62, the tape may also be provided between any two layers within the annulus, namely, between the pressure sheath 54 and the pressure armor layer 56, between the pressure armor layer 56 and inner tensile armor layer 60, between the armor wire layers 60 and 62, between armor wire layer 62 and the external sheath 11, and/or between any other additional layer which the annulus may contain and an adjacent layer.

Figure 6A:
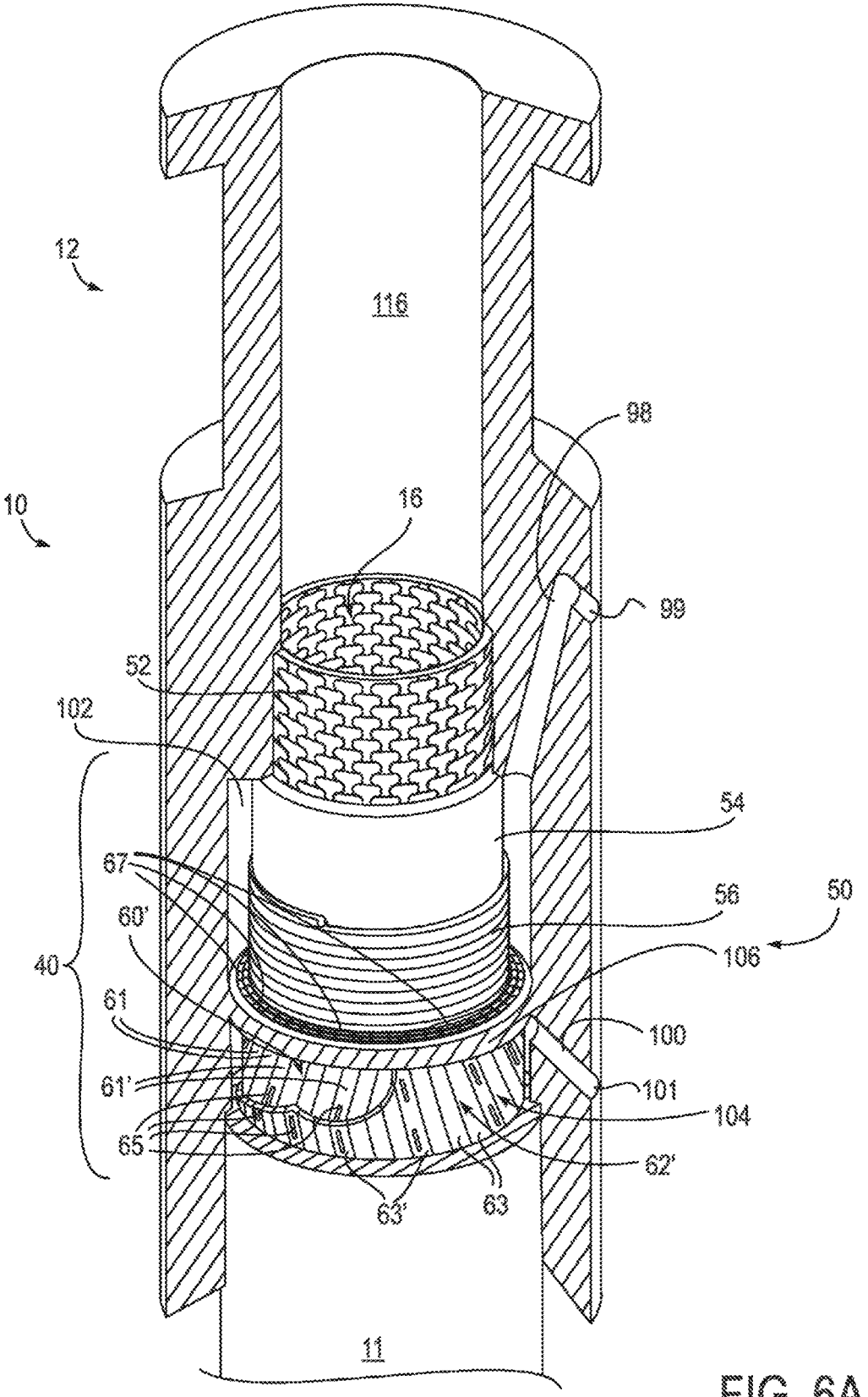
FIGS. 6A-6C illustrate a flexible pipe riser in mating relation to a topsides end fitting according to one embodiment.

Referring again to FIG. 1A, the flexible pipe riser 10 is attached to topsides end fitting 12. FIG. 6A is an exploded view of the flexible pipe riser 10 in mating relation with the topsides end fitting 12 according to one embodiment. In this view, the flexible pipe riser 10 as already described and shown in FIG. 1C is mated with topsides end fitting 12 such that the bore 116 of the end fitting is in fluid communication with the bore 16 of the flexible pipe riser 10. The end fitting 12 includes an opening 99 and channel 98 in fluid communication with at least one buffer fluid tube in the annulus of the flexible pipe riser 10, such that fluid can be pumped into the buffer fluid tubes 61' and 63' via the opening 99 and channel 98. In the particular embodiment shown, segregating wall 106 separates the inlet portion 102 of the annulus (in fluid communication with opening 99) from outlet portion 104 of the annulus in fluid communication with an opening 101. The segregating wall 106 helps direct the flow of buffer fluid into the open ends 67 of the buffer fluid tubes. Opening 101 and channel 100 are in fluid communication with outlet portion 104 of the annulus. It will be appreciated by one of ordinary skill in the art that many other particular embodiments for introducing buffer fluid into the buffer fluid tubes 61' and 63' could also be employed.

Figure 6B:
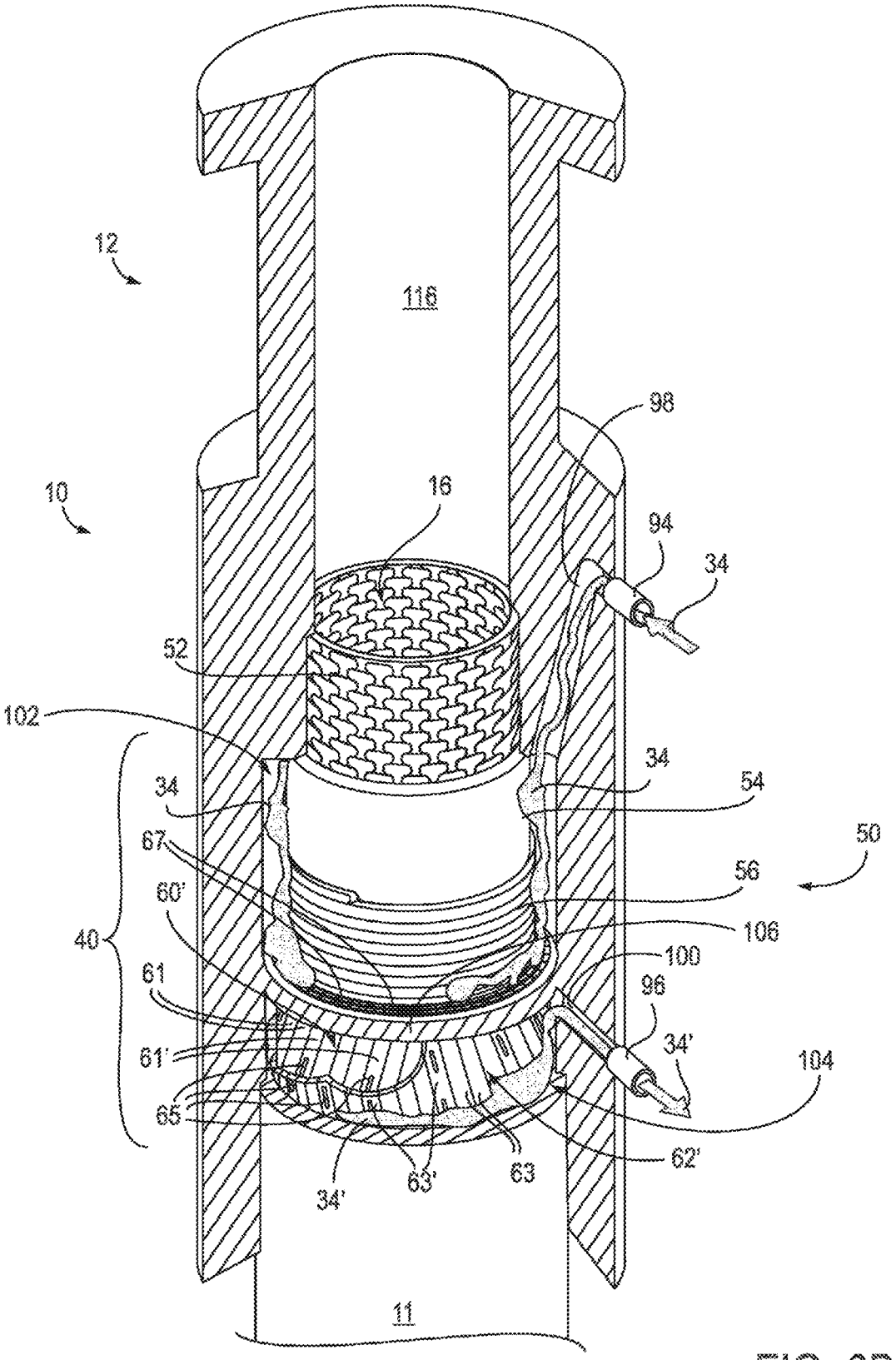
Figure 6C:
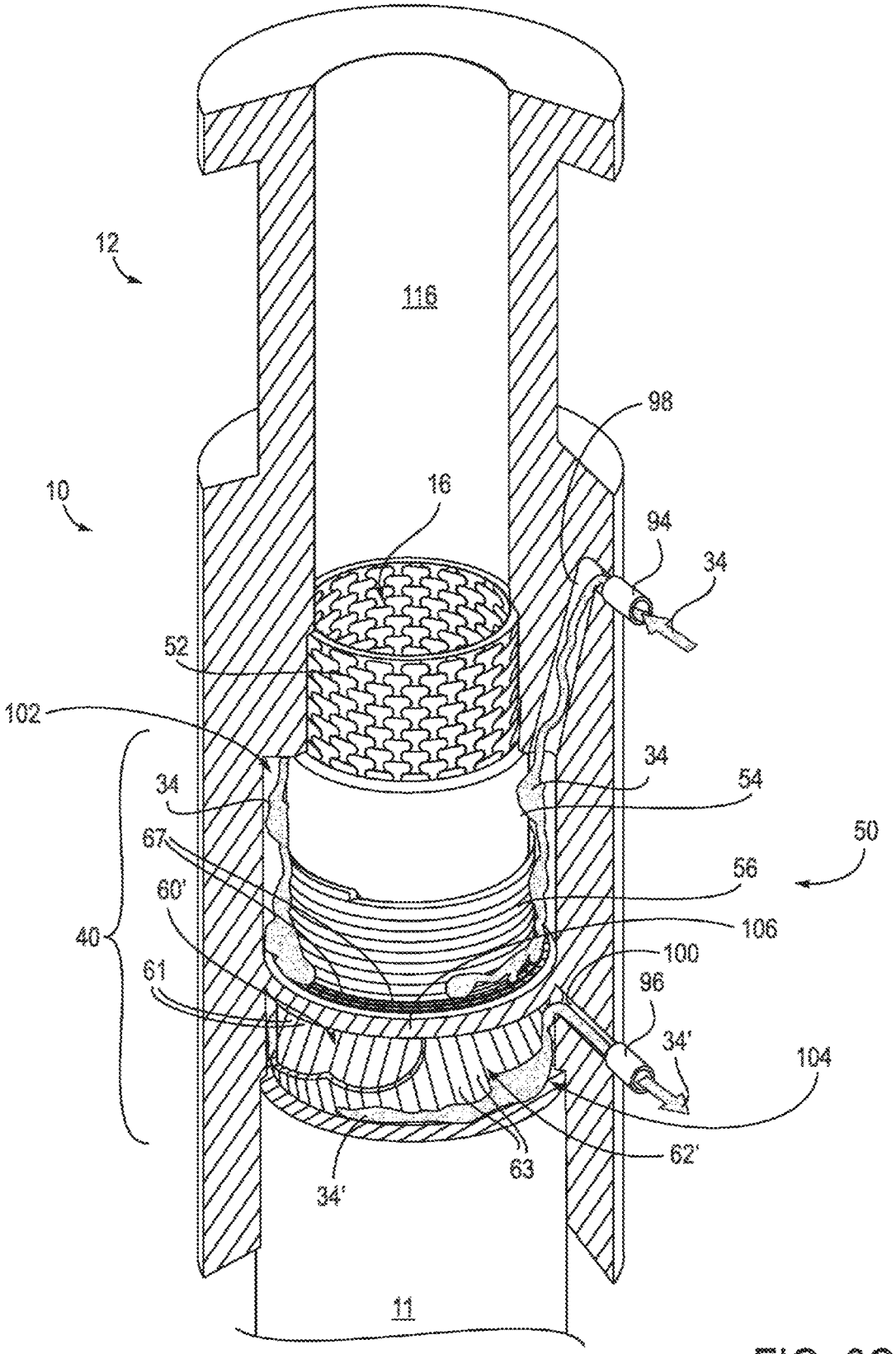

FIG. 6B shows the apparatus of FIG. 6A with buffer fluid 34 being introduced through inlet port 94 and channel 98, entering the inlet portion 102 of the annulus and open ends 67 of perforated buffer fluid tubes 61' and 63' within the armor wire layers according to one embodiment. In one embodiment, the inlet port 94 is in fluid communication with the pump as previously described. The fluid 34' flows through the annulus along the length of the flexible pipe riser 10 and returns to the topsides end fitting 12, exiting through the outlet portion 104 of the annulus and the channel 100 and the outlet port 96. The exiting buffer fluid 34' can then be returned to the storage tank. FIG. 6C illustrates a similar apparatus according to another embodiment in which the buffer fluid tubes 61 and 63 have solid walls.

Example Methods

The buffer fluids described herein can be used to treat metal surfaces within the annulus of a flexible pipe, e.g., a flexible pipe riser in an offshore hydrocarbon production facility. Treatment of the metal surfaces in the annulus of the flexible pipe with the buffer fluids can be accomplished by flushing, or simply filling, the annulus of the flexible pipe with the buffer fluids, alone or in a carrier, by any suitable means to form a protective layer on the metal surfaces. Exemplary methods for preparing the coated or passivated flexible pipes are described below. As referenced above and as explained further below, the buffer fluid of the example methods comprises one or more of the passivating agents described herein and may also include one or more of the corrosion inhibitors described previously and described further in the test samples referenced below in connection with FIGS. 7A-16B.

In a first embodiment, a method for preventing or reducing corrosion within the annulus of a flexible pipe riser in an offshore hydrocarbon production facility comprises: pumping a buffer fluid comprising one or more passivating agents into an inlet port in a topsides riser end fitting in fluid communication with at least one tube within an annulus of a flexible pipe riser wherein the at least one tube has at least one opening within the annulus, the flexible pipe riser having one end terminating at the topsides riser end fitting in fluid communication with the at least one tube within the annulus and another end terminating at a subsea riser end fitting; and discharging the buffer fluid from the at least one opening of the at least one tube into the annulus such that the buffer fluid flows in the annulus and returns to the topsides riser end fitting in a closed loop. The one or more passivating agents of the buffer fluid are selected from the passivating agents previously described. Additionally, the buffer fluid may include one or more of the corrosion inhibitors described herein.

In certain alternative embodiments of the first embodiment, the surfaces within the flexible pipe riser may be pretreated with a pretreating corrosion inhibitor before the buffer fluid comprising the passivating agent is introduced into the flexible pipe riser. Examples of pretreating corrosion inhibitors have been provided above. Furthermore, the discussion below of the test results illustrated in FIGS. 7A-16B explains that pretreating with a solution comprising isooctyltriethoxysilane has been demonstrated to inhibit corrosion.

In certain other alternatives of the first embodiment, the method further comprises returning the buffer fluid to a storage tank; removing contaminants from the fluid; and repeating the method to recirculate the buffer fluid within the annulus of the flexible pipe riser, i.e., repeating the step of: pumping a buffer fluid comprising one or more passivating agents into an inlet port in a topsides riser end fitting in fluid communication with a plurality of tubes within at least one tape layer free of metal wires within an annulus of a flexible pipe riser wherein each of the plurality of tubes has at least one opening within the annulus, the flexible pipe riser having one end terminating at the topsides riser end fitting in fluid communication with the plurality of tubes within the at least one tape layer and another end terminating at a subsea riser end fitting; and discharging the buffer fluid from the openings of the plurality of tubes within at least one tape layer into the annulus such that the buffer fluid flows in the annulus and returns to the topsides riser end fitting in a closed loop.

In yet another alternative of the first embodiment, instead of circulating the buffer fluid through the annulus in a closed loop, the flexible pipe riser is pre-charged with one of the buffer fluids described herein. Pre-charging the flexible pipe riser with the buffer fluid may be performed during manufacturing of the flexible pipe riser or before installation of the flexible pipe riser. The method comprises: pumping one of the example buffer fluids described herein into an inlet port of the flexible pipe riser, wherein the buffer fluid flows through at least one tube into an annulus of the flexible pipe riser, wherein at least one tube has an opening within the annulus, and closing the inlet port sealing the buffer fluid within the flexible pipe riser.

In a second embodiment, a method for preventing or reducing corrosion within the annulus of a flexible pipe riser in an offshore hydrocarbon production facility comprises: a) pumping a buffer fluid comprising one or more passivating agents into an inlet port in a topsides riser end fitting in fluid communication with a plurality of tubes within at least one tape layer within an annulus of a flexible pipe riser wherein each of the plurality of tubes has at least one opening within the annulus, the flexible pipe riser having one end terminating at the topsides riser end fitting in fluid communication with the plurality of tubes within the at least one tape layer and another end terminating at a subsea riser end fitting; b) discharging the buffer fluid from the openings of the plurality of tubes within at least one tape layer into the annulus such that the buffer fluid flows in the annulus and returns to the topsides riser end fitting in a closed loop; c) returning the buffer fluid to a storage tank; d) removing contaminants from the buffer fluid; and e) repeating steps (a) through (d) to recirculate the buffer fluid within the annulus of the flexible pipe riser loop. The one or more passivating agents of the buffer fluid are selected from the passivating agents previously described. Additionally, the buffer fluid may include one or more of the corrosion inhibitors described herein.

In certain embodiments, the plurality of tubes have solid walls and the buffer fluid is discharged from openings at the ends of the plurality of tubes at the subsea location.

In certain embodiments, the plurality of tubes have perforated walls and the buffer fluid is discharged from perforations along the lengths of the plurality of tubes.

In certain embodiments, the method further comprises, upon returning the buffer fluid to the topsides end fitting, discharging the buffer fluid from the topsides end fitting through an outlet port.

In certain embodiments of the foregoing method, instead of circulating the buffer fluid through the annulus in a closed loop, the flexible pipe riser is pre-charged with one of the example buffer fluids described herein. Pre-charging the flexible pipe riser with the buffer fluid may be performed during manufacturing of the flexible pipe riser or before installation of the flexible pipe riser.

In certain embodiments of the foregoing method, the surfaces within the flexible pipe riser may be pretreated with a pretreating corrosion inhibitor before the buffer fluid comprising the passivating agents is introduced into the flexible pipe riser. Examples of pretreating corrosion inhibitors have been provided above.

In a third embodiment, a method for preventing or reducing corrosion in an offshore hydrocarbon production facility is provided. The method comprises: a) pumping a buffer fluid comprising one or more passivating agents into an inlet port in a topsides riser end fitting in fluid communication with a plurality of tubes within an annulus of a flexible pipe riser wherein each of the plurality of tubes comprises at least one opening within the annulus, the flexible pipe riser comprising one end terminating at the topsides riser end fitting in fluid communication with the plurality of tubes within the annulus and another end terminating at a subsea riser end fitting; and b) discharging the buffer fluid from the openings of the plurality of tubes into the annulus such that the buffer fluid flows in the annulus; wherein the one or more passivating agents comprises polybutene.

In certain implementations of the third embodiment, the polybutene has an average molecular weight of 350 to 510 Daltons.

In certain implementations of the third embodiment, the polybutene has a kinematic viscosity of 3-17 cSt at 100 degrees C.

In certain implementations of the third embodiment, the polybutene has a pour point of −55 to −30 degrees C.

In another example based upon the third embodiment, the passivating agent comprises a combination of polybutene with a corrosion inhibitor. As non-limiting examples, the corrosion inhibitor can be any of the example corrosion inhibitors described herein. As described further below in connection with the discussion of the test results illustrated in FIGS. 8A and 8B, the corrosion inhibitor may be an alkenylsuccinic acid-based corrosion inhibitor.

In certain embodiments of the foregoing method, instead of circulating the buffer fluid through the annulus in a closed loop, the flexible pipe riser is pre-charged with a buffer fluid comprising the one or more passivating agents. Pre-charging the flexible pipe riser with the buffer fluid may be performed during manufacturing of the flexible pipe riser or before installation of the flexible pipe riser.

In certain embodiments of the foregoing method, the surfaces within the flexible pipe riser may be pretreated with a pretreating corrosion inhibitor before the buffer fluid comprising the passivating agents is introduced into the flexible pipe riser. Examples of pretreating corrosion inhibitors have been provided above.

In a fourth embodiment, a method for preventing or reducing corrosion in an offshore hydrocarbon production facility is provided. The method comprises: a) pumping a buffer fluid comprising one or more passivating agents into an inlet port in a topsides riser end fitting in fluid communication with a plurality of tubes within an annulus of a flexible pipe riser wherein each of the plurality of tubes comprises at least one opening within the annulus, the flexible pipe riser comprising one end terminating at the topsides riser end fitting in fluid communication with the plurality of tubes within the annulus and another end terminating at a subsea riser end fitting; and b) discharging the buffer fluid from the openings of the plurality of tubes into the annulus such that the buffer fluid flows in the annulus; wherein the one or more passivating agents comprises a polyalphaolefin formed using $C_6$-$C_{12}$ alkene. The polyalphaolefin passivating agent will have a relatively low viscosity to facilitate pumping the agent through narrow spaces within a flexible pipe apparatus so that it can adhere to the surfaces that are to be protected from corrosion. As an example, the polyalphaolefin used as a passivating agent can have a kinematic viscosity of 1.5 to 10 cSt at 100 degrees C., or 4 to 8 cSt at 100 degrees C., or 4.1 cSt at 100 degrees C., as measured using ASTM D445.

Preferably, the polyalphaolefin passivating agent will have a relatively low pour point to facilitate use in cold water environments. As examples, the polyalphaolefin passivating agent can have a pour point of −73 to −30 degrees C., or −68 to −60 degrees C., or −66 degrees C., as measured using ASTM D97.

As described further below in connection with the discussion of the test results illustrated in FIGS. 7A-7C, a commercially available polyalphaolefin synthetic lubricant known as SPECTRASYN 4 from EXXONMOBIL has been shown to be particularly effective at inhibiting corrosion. SPECTRASYN 4 has a kinematic viscosity of 4.1 cSt at 100 degrees C., as measured using ASTM D445, and a pour point of −66 degrees C., as measured using ASTM D97.

In another example based upon the fourth embodiment, the passivating agent comprises a combination of polyalphaolefin with a corrosion inhibitor. As non-limiting examples, the corrosion inhibitor can be any of the example corrosion inhibitors described herein. As described further below in connection with the discussion of the test results illustrated in FIGS. 14A-16B, the corrosion inhibitor may be an alkenylsuccinic acid-based corrosion inhibitor.

In certain examples of the fourth embodiment, the surfaces within the flexible pipe riser may be pretreated with a pretreating corrosion inhibitor before the buffer fluid comprising the passivating agents is introduced into the flexible pipe riser. Examples of pretreating corrosion inhibitors have been provided above.

In a fifth embodiment, a method for preventing or reducing corrosion in an offshore hydrocarbon production facility is provided. The method comprises: a) pumping a buffer fluid comprising one or more passivating agents into an inlet port in a topsides riser end fitting in fluid communication with a plurality of tubes within an annulus of a flexible pipe riser wherein each of the plurality of tubes comprises at least one opening within the annulus, the flexible pipe riser comprising one end terminating at the topsides riser end fitting in fluid communication with the plurality of tubes within the annulus and another end terminating at a subsea riser end fitting; and b) discharging the buffer fluid from the openings of the plurality of tubes into the annulus such that the buffer fluid flows in the annulus; wherein the one or more passivating agents comprises one or more polysiloxane compounds selected from Formula I:

Formula I

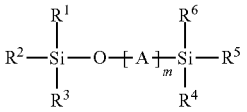

wherein each

[A]

is the same or different and is a divalent unit represented by the structure:

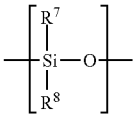

wherein $R^7$ is $C_1$ to $C_{18}$ alkyl or $C_6$ to $C_{22}$ aryl, optionally substituted by one or more hydroxy, alkoxy, carboxy, amino, aryl, heteroaryl, or polyether groups, or any combination thereof;

$R^8$ is $C_1$ to $C_{24}$ alkyl or $C_6$ to $C_{22}$ aryl, optionally substituted by one or more hydroxy, alkoxy, carboxy, amino, aryl, heteroaryl, or polyether groups, or any combination thereof;

m is an integer greater than or equal to 1;

$R^1$, $R^2$, $R^3$, $R^4$, $R^5$ and $R^6$ are independently selected from $C_1$ to $C_6$ alkyl or $C_6$ to $C_{22}$ aryl;

and optionally, one or more of $R^1$, $R^2$, $R^3$, $R^4$, $R^5$, $R^6$, $R^7$ and $R^8$ are substituted with phosphonic acid (—P(═O)(OH)$_2$)) or phosphonate (—P(═O)(OR$^9$)$_2$ wherein $R^9$ is $C_1$ to $C_6$ alkyl or $C_6$ to $C_{22}$ aryl).

In another example based upon the fifth embodiment, the passivating agent comprises a combination of a polysiloxane compound with a corrosion inhibitor. As non-limiting examples, the corrosion inhibitor can be any of the example corrosion inhibitors described herein.

In certain examples of the fifth embodiment, the surfaces within the flexible pipe riser may be pretreated with a pretreating corrosion inhibitor before the buffer fluid comprising the passivating agents is introduced into the flexible pipe riser. Examples of pretreating corrosion inhibitors have been provided above.

Testing

FIGS. 7A-16B relate to corrosion inhibition testing that was performed involving the passivating agents described herein. The test method employed was ASTM D665. The following description summarizes the ASTM D665 test method used in the testing illustrated in FIGS. 7A-16B:

A sample of 300 mL of the oil (passivating agent) being evaluated is mixed with 30 mL of distilled water or synthetic sea water, depending on the requirement, and maintained at a temperature of 60° C.±1° C. with a fully submerged cylindrical steel test rod. The recommended duration for the test is 4 hours; however, this period can be adjusted to a longer or shorter time at the discretion of the involved parties. The test rod is then checked for any rust formation and, if needed, the extent of rusting.

As described further below, in certain instances of the testing, the effect of the example passivating agent alone on corrosion inhibition was evaluated. In other instances of the testing, the passivating agent was evaluated in combination with a hydrophobic pretreating corrosion inhibitor, in this case, isooctyltriethoxysilane. In yet other instances of the testing, the passivating agent was evaluated in combination with an alkenylsuccinic acid-based corrosion inhibitor. And in yet other instances of the testing, the passivating agent was evaluated in combination with an alkenylsuccinic acid-based corrosion inhibitor and with a hydrophobic pretreating corrosion inhibitor (isooctyltriethoxysilane).

Figure 7A:
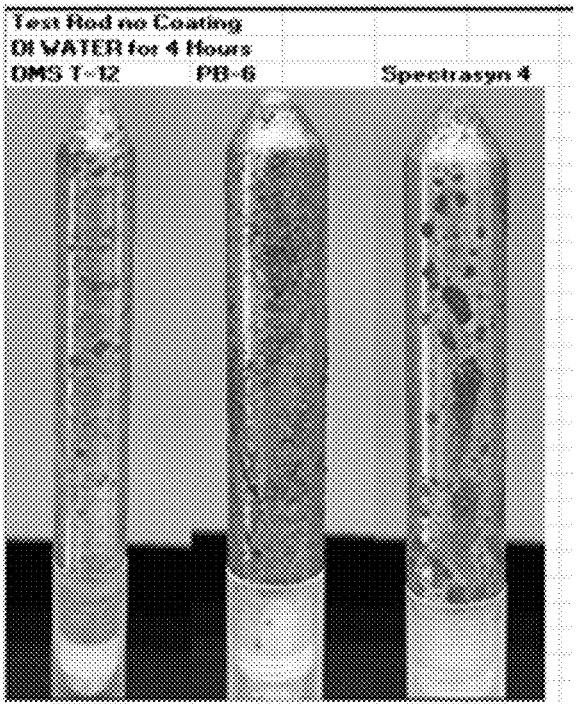
FIG. 7A illustrates ASTM D665 test results for three steel rods, each of which was submerged in a buffering fluid comprising a passivating agent.
Figure 7B:
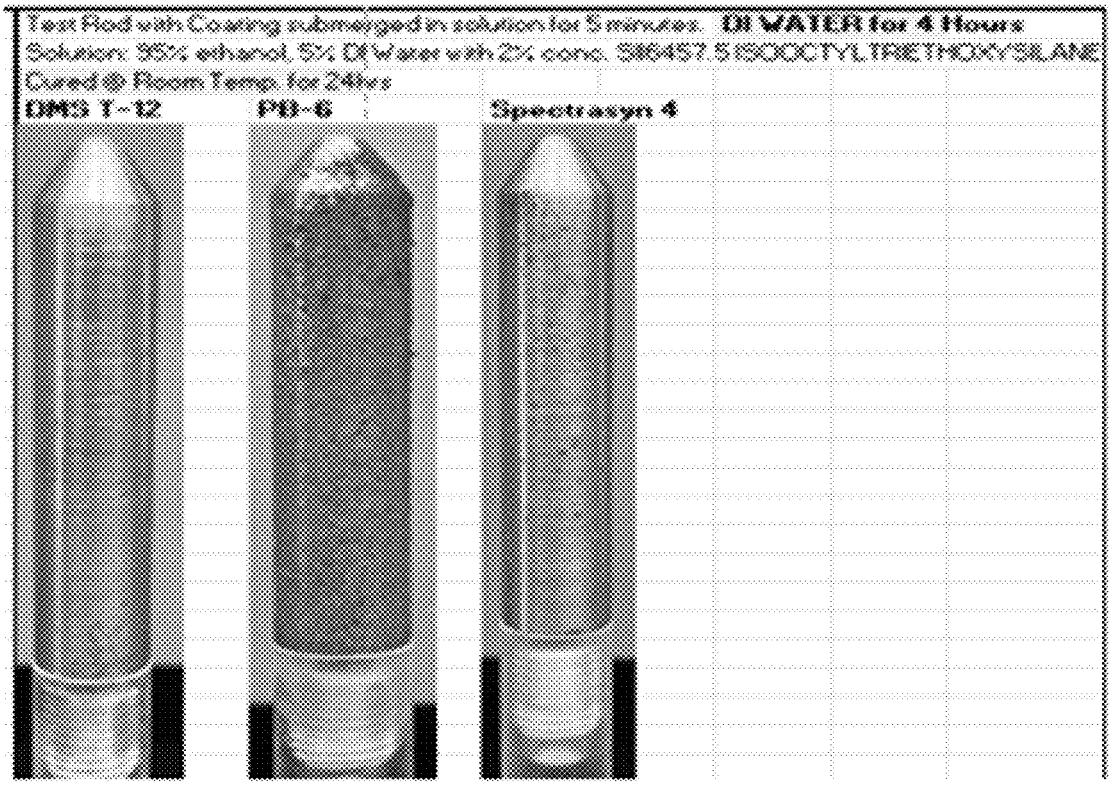
FIG. 7B illustrates ASTM D665 test results for three steel rods, each of which received a silane pretreating corrosion inhibitor followed by submersion in distilled water with a buffering fluid comprising a passivating agent.

FIGS. 7A-7B illustrate two sets of testing performed on steel rods with different passivating agents. As illustrated in FIG. 7A, three steel rods were submerged in the following three solutions for four hours, respectively: (1) a solution of a polysiloxane compound, dimethylsiloxane T-12 (DM ST-12), and distilled water, (2) a solution of polybutene (PB-6) and distilled water, and (3) a solution of a polyalphaolefin, SPECTRASYN 4, and distilled water. Corrosion is evident on each of the three steel rods. For the three steel rods tested in connection with FIG. 7A, no pretreating corrosion inhibitor was applied to the steel rods before submerging them in the respective solutions (1), (2), and (3).

In connection with FIG. 7B, three steel rods were tested again using the same solutions (1), (2), and (3) as with FIG. 7A, however, each of the three steel rods were pretreated with a pretreating corrosion inhibitor before submerging them in the solutions. Specifically, the pretreatment involved submerging each test rod in a pretreating corrosion inhibitor comprising 95% ethanol and 5% distilled water having a 2% concentration of isooctyltriethoxysilane, which is a hydrophobic silane. The pretreatment occurred at room temperature for a duration of 24 hours. Relative to the results illustrated in FIG. 7A, the rods illustrated in FIG. 7B showed improvements with respect to reduced visual evidence of corrosion for steel rod (1) (submerged in a solution of dimethylsiloxane T-12 (DMST-12) and distilled water) and for steel rod (3) (submerged in a solution of SPECTRASYN 4 and distilled water).

Figure 8A:
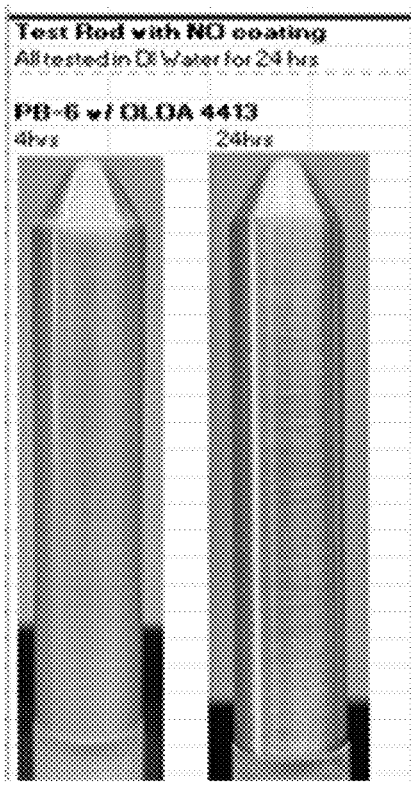
FIG. 8A illustrates ASTM D665 test results for two steel rods, each of which was submerged in distilled water with a buffering fluid comprising a polybutene and an alkenylsuccinic acid-based corrosion inhibitor.
Figure 8B:
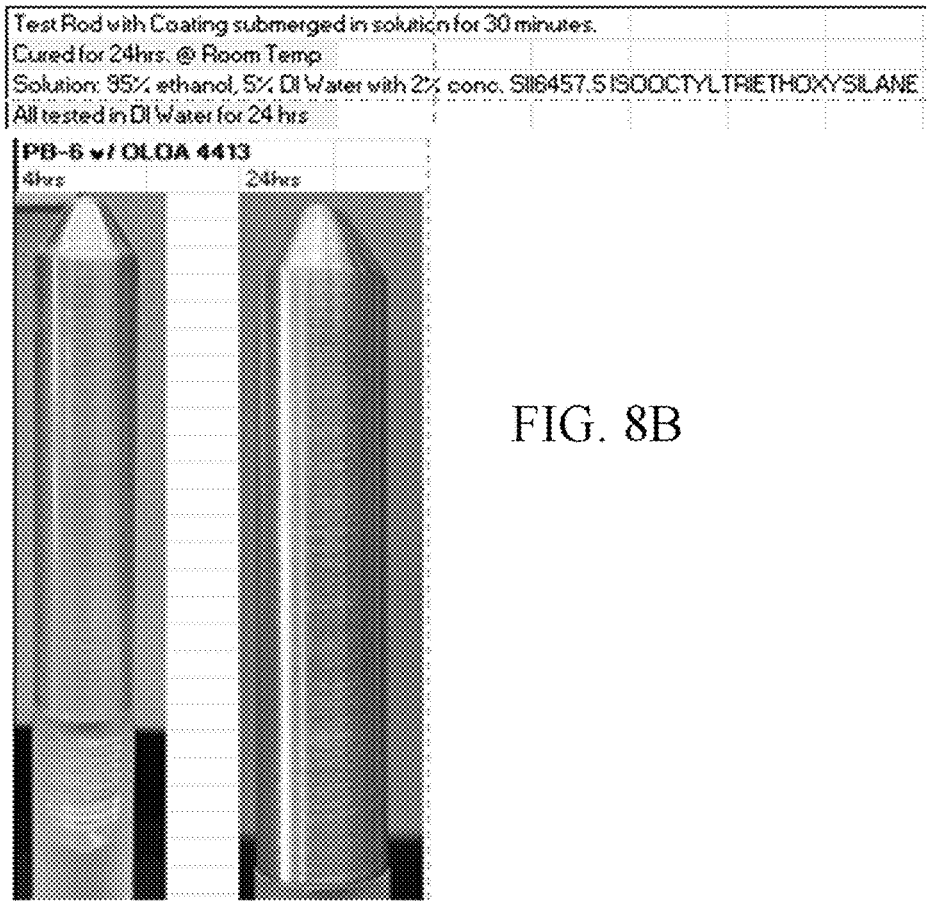
FIG. 8B illustrates ASTM D665 test results for two steel rods, each of which received a silane pretreating corrosion inhibitor followed by submersion in distilled water with a buffering fluid comprising a polybutene and an alkenylsuccinic acid-based corrosion inhibitor.
Figure 8C:
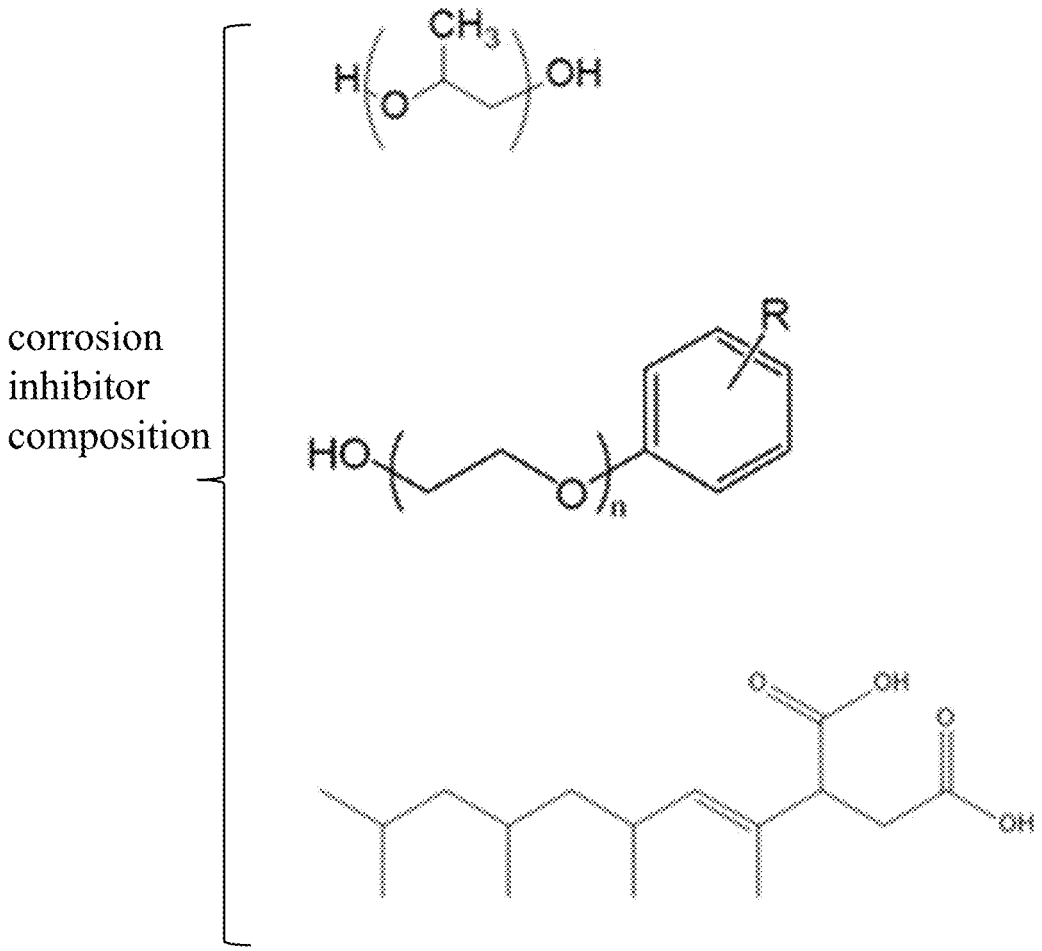
FIG. 8C illustrates the chemical structure of an alkenylsuccinic acid-based corrosion inhibitor.

FIGS. 8A and 8B illustrate additional testing performed on steel rods using a buffering fluid that is a combination of polybutene (as the passivating agent) and an alkenylsuccinic acid-based corrosion inhibitor (OLOA® 4413), which is a commercially available corrosion inhibitor as described previously. As described above, the alkenylsuccinic acid-based corrosion inhibitor used in the testing comprises three components and their chemical structures are shown in FIG. 8C. As illustrated in FIG. 8A, a steel rod was submerged in a solution of polybutene (PB-6), alkenylsuccinic acid-based corrosion inhibitor, and distilled water. Images of the rod were captured after 4 hours of submersion and after 24 hours of submersion. As the images in FIG. 8A demonstrate, there is very little visible evidence of corrosion. For the rod tested in connection with FIG. 8A, no pretreatment coating was applied to the steel rod before submerging it in the buffering fluid comprising PB-6 and the alkenylsuccinic acid-based corrosion inhibitor.

FIG. 8B illustrates testing of a steel rod again using the same passivating agent as with FIG. 8A, however, the steel rod illustrated in FIG. 8B was pretreated before submerging it in the passivating agent. Specifically, the pretreatment involved submerging the test rod in a pretreating corrosion inhibitor solution comprising 95% ethanol and 5% distilled water having a 2% concentration of isooctyltriethoxysilane. The pretreatment occurred at room temperature for a duration of 24 hours. Similar to the results illustrated in FIG. 8A, the rod illustrated in FIG. 8B showed very little visible evidence of corrosion.

Figure 9A:
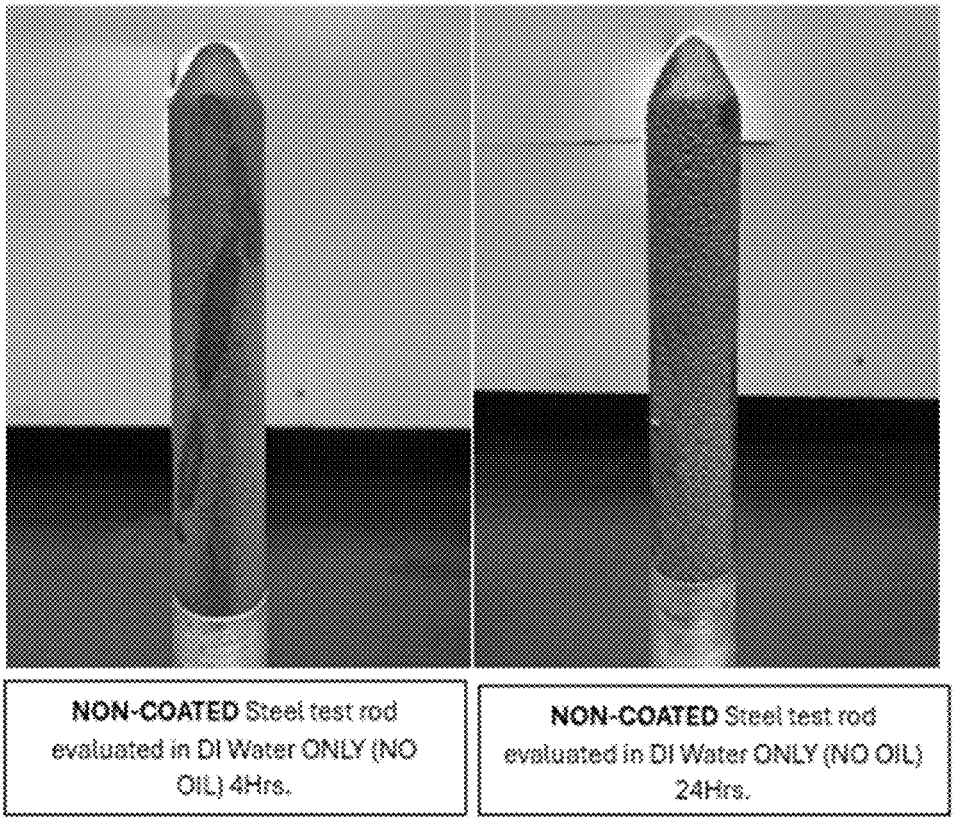
FIG. 9A illustrates ASTM D665 test results for two steel rods submerged in distilled water without a pretreating corrosion inhibitor and without a buffering fluid.
Figure 9B:
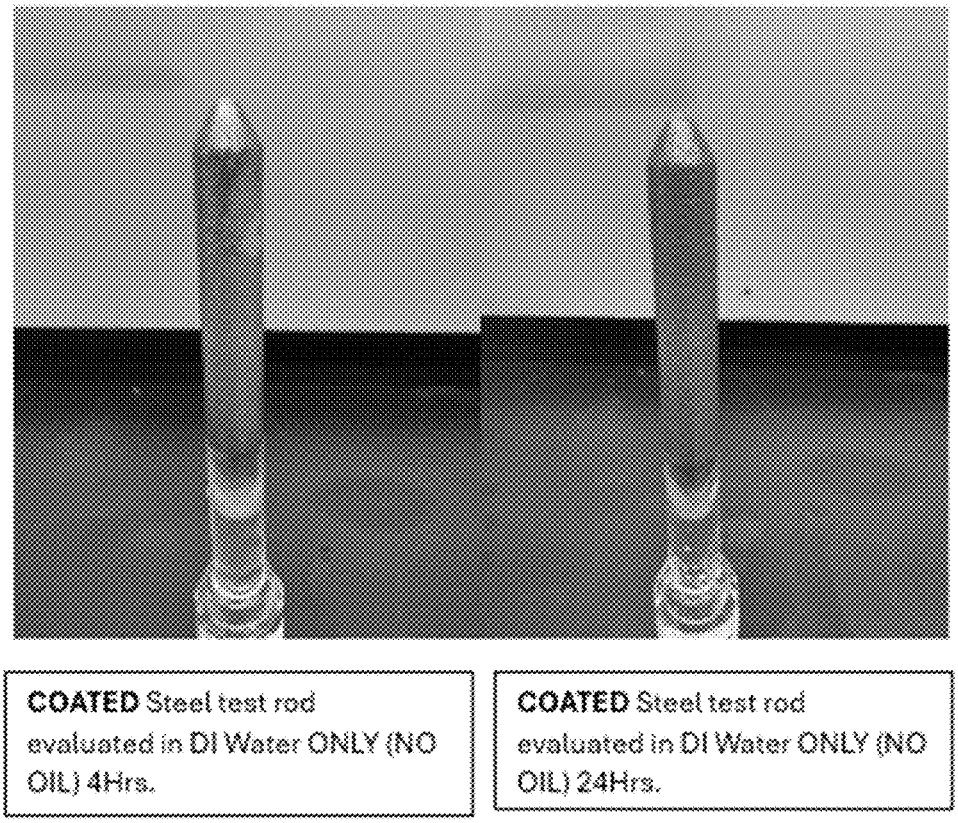
FIG. 9B illustrates ASTM D665 test results for two steel rods, each of which received a silane pretreating corrosion inhibitor followed by submersion in distilled water without a buffering fluid.

FIGS. 9A and 9B illustrate additional testing performed on steel rods, but without a buffering fluid to establish a base line of test results for comparing against the testing with a buffering fluid. FIG. 9A shows the test results for two steel rods submerged in distilled water for periods of 4 hours and 24 hours without a pretreating corrosion inhibitor and without a buffering fluid. The images in FIG. 9A show significant corrosion on the steel rods resulting from the submersion in distilled water. In contrast, FIG. 9B shows test results for two rods that were treated with the isooctyltriethoxysilane pretreating corrosion inhibitor using the same method described above for FIG. 7B. After the pretreating, the two rods in FIG. 9B were submerged in distilled water for periods of 4 hours and 24 hours without a buffering fluid. Relative to the results in FIG. 9A, the results in FIG. 9B show a reduction in corrosion of the steel rods.

Figure 10A:
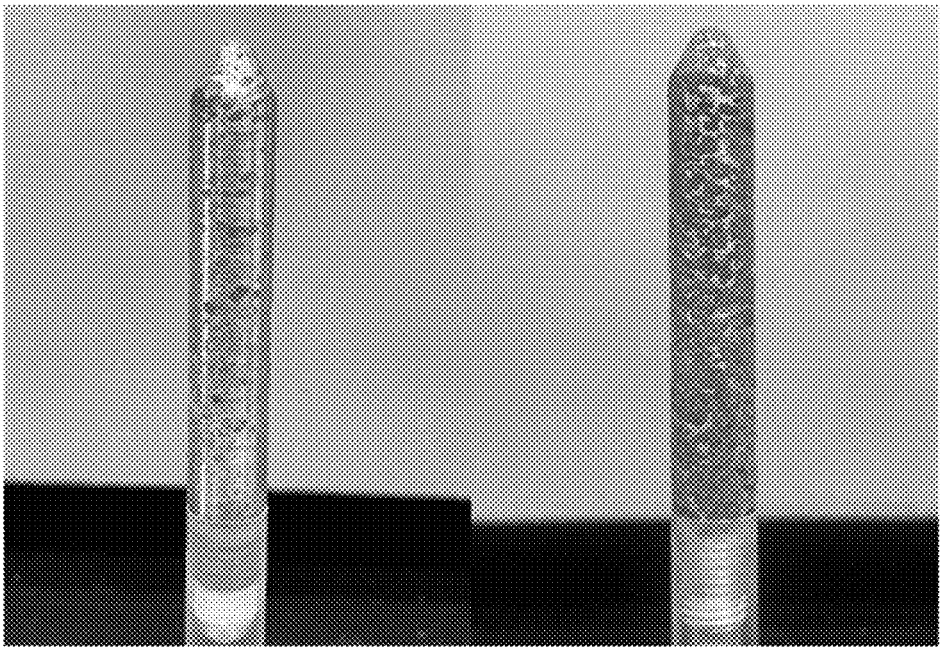
FIG. 10A illustrates ASTM D665 test results for two steel rods, each of which was submerged in distilled water with a buffering fluid comprising polydimethylsiloxane.
Figure 10B:
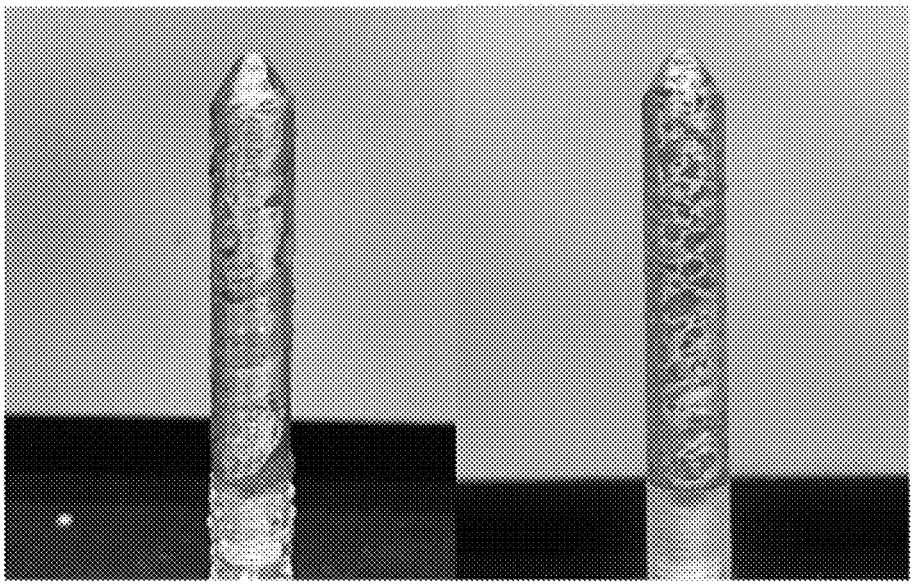
FIG. 10B illustrates ASTM D665 test results for two steel rods, each of which received a silane pretreating corrosion inhibitor followed by submersion in distilled water with a buffering fluid comprising polydimethylsiloxane.

FIGS. 10A and 10B illustrate additional testing performed on steel rods with a buffering solution that included polydimethylsiloxane (DMST-12), which is an alkyl-substituted polysiloxane compound as described above. FIG. 10A shows the test results for two steel rods submerged in distilled water and DMST-12 for periods of 4 hours and 24 hours without a pretreating corrosion inhibitor. The images in FIG. 10A show significant corrosion on the steel rods resulting from the submersion in distilled water. In contrast, FIG. 10B shows test results for two rods that were treated with the isooctyltriethoxysilane pretreating corrosion inhibitor using the same method described above for FIG. 7B. After the pretreating, the two rods in FIG. 10B were submerged in distilled water and DMST-12 for periods of 4 hours and 24 hours. Relative to the results in FIG. 10A, the results in FIG. 10B show a reduction in corrosion of the steel rods.

Figure 11A:
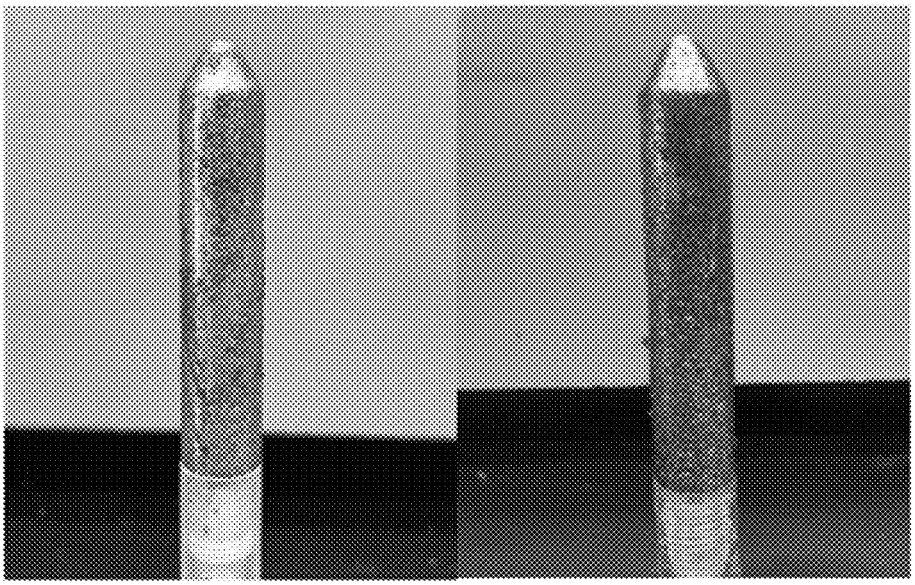
FIG. 11A illustrates ASTM D665 test results for two steel rods, each of which was submerged in distilled water with a buffering fluid comprising a polybutene.
Figure 11B:
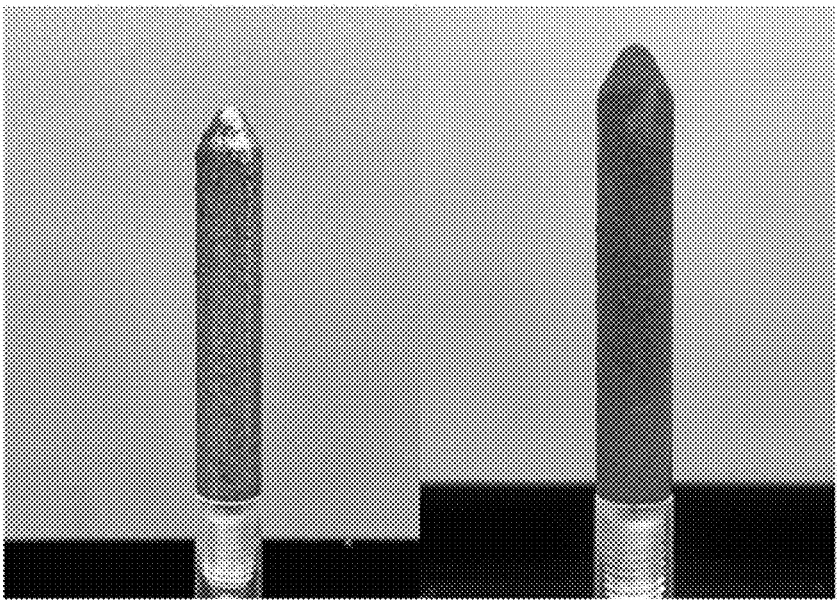
FIG. 11B illustrates ASTM D665 test results for two steel rods, each of which received a silane pretreating corrosion inhibitor followed by submersion in distilled water with a buffering fluid comprising a polybutene.

FIGS. 11A and 11B illustrate additional testing performed on steel rods with a buffering solution that included a polybutene (PB-6) as described above. FIG. 11A shows the test results for two steel rods submerged in distilled water and PB-6 for periods of 4 hours and 24 hours without a pretreating corrosion inhibitor. The images in FIG. 11A show corrosion on the steel rods resulting from the submersion in distilled water. In contrast, FIG. 11B shows test results for two rods that were treated with the isooctyltriethoxysilane pretreating corrosion inhibitor using the same method described above for FIG. 7B. After the pretreating, the two rods in FIG. 11B were submerged in distilled water and PB-6 for periods of 4 hours and 24 hours. Relative to the results in FIG. 11A, the results in FIG. 11B show similar amounts of corrosion on the steel rods.

Figure 12A:
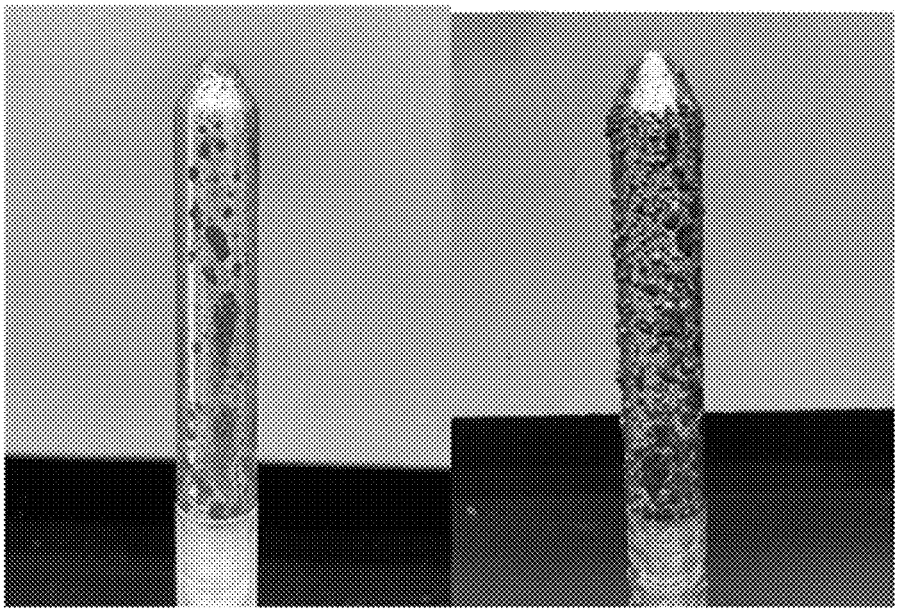
FIG. 12A illustrates ASTM D665 test results for two steel rods, each of which was submerged in distilled water with a buffering fluid comprising a polyalphaolefin.
Figure 12B:
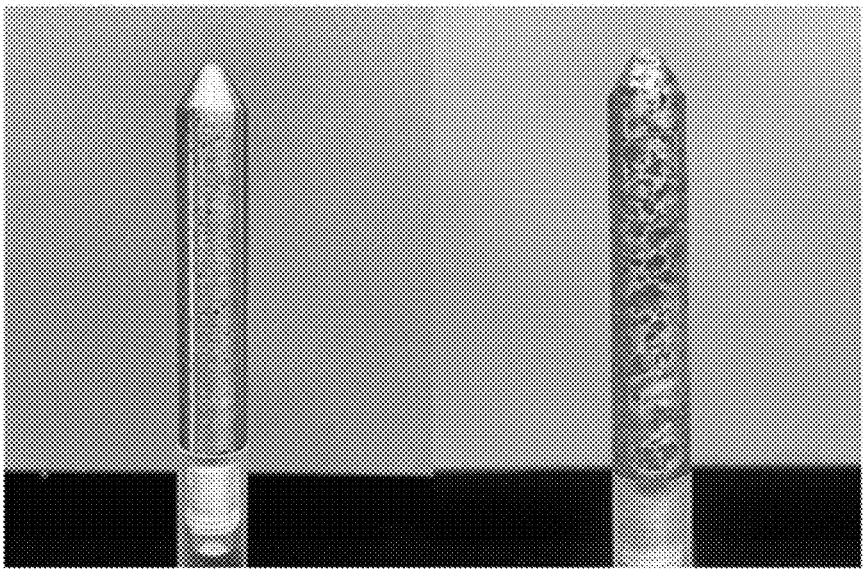
FIG. 12B illustrates ASTM D665 test results for two steel rods, each of which received a silane pretreating corrosion inhibitor followed by submersion in distilled water with a buffering fluid comprising a polyalphaolefin.

FIGS. 12A and 12B illustrate additional testing performed on steel rods with a buffering solution that included a polyalphaolefin (PAO4—SPECTRASYN) as described above. FIG. 12A shows the test results for two steel rods submerged in distilled water and PAO4 for periods of 4 hours and 24 hours without a pretreating corrosion inhibitor. The images in FIG. 12A show corrosion on the steel rods resulting from the submersion in distilled water. In contrast, FIG. 12B shows test results for two rods that were treated with the isooctyltriethoxysilane pretreating corrosion inhibitor using the same method described above for FIG. 7B. After the pretreating, the two rods in FIG. 12B were submerged in distilled water and PAO4 for periods of 4 hours and 24 hours. Relative to the results in FIG. 12A, the results in FIG. 12B show a reduction in corrosion on the steel rods.

FIGS. 13A and 13B illustrate additional testing performed on steel rods with a buffering solution that included a combination of a polybutene (PB-6) and 1.05 wt % of the alkenylsuccinic acid-based corrosion inhibitor as described above. FIG. 13A shows the test results for two steel rods submerged in distilled water and the buffering solution for periods of 4 hours and 24 hours without a pretreating corrosion inhibitor. The images in FIG. 13A show very little corrosion on the steel rods after the submersion in distilled water and buffering solution. FIG. 13B shows test results for two rods that were treated with the isooctyltriethoxysilane pretreating corrosion inhibitor using the same method described above for FIG. 7B. After the pretreating, the two rods in FIG. 13B were submerged in distilled water and the buffering solution for periods of 4 hours and 24 hours. Similar to FIG. 13A, FIG. 13B shows very little corrosion on the steel rods after submersion in the distilled water and buffering solution.

Figure 14A:
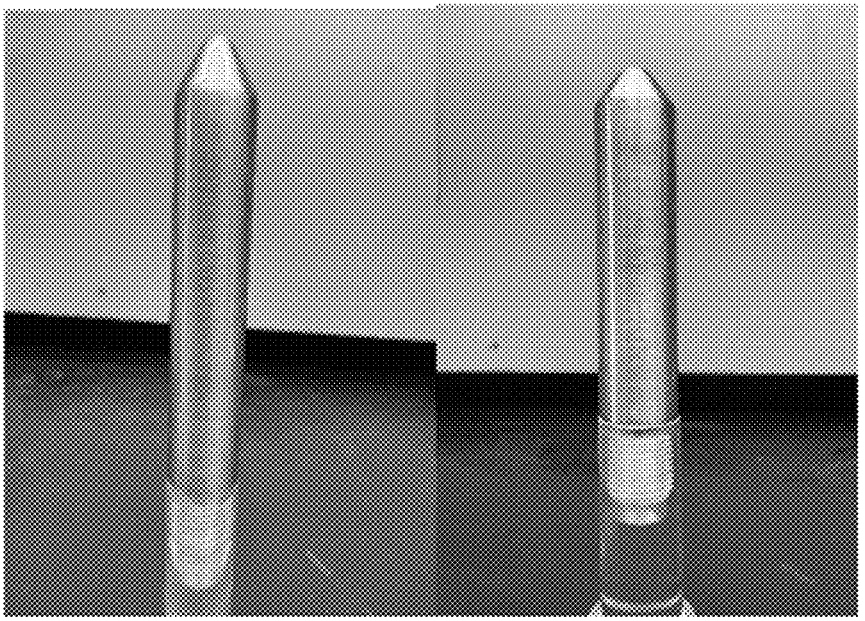
FIG. 14A illustrates ASTM D665 test results for two steel rods, each of which was submerged in distilled water with a buffering fluid comprising a polyalphaolefin and 1.05 wt % of an alkenylsuccinic acid-based corrosion inhibitor.
Figure 14B:
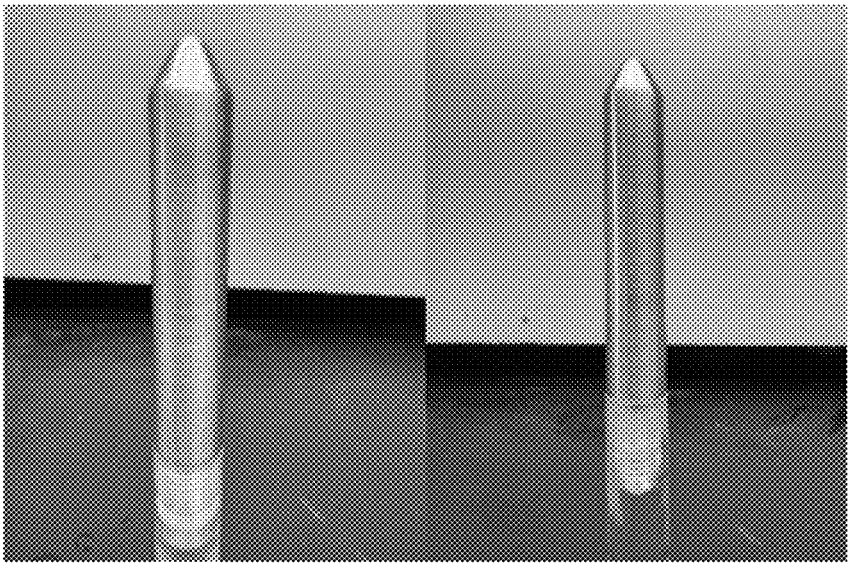
FIG. 14B illustrates ASTM D665 test results for two steel rods, each of which received a silane pretreating corrosion inhibitor followed by submersion in distilled water with a buffering fluid comprising a polyalphaolefin and 1.05 wt % of an alkenylsuccinic acid-based corrosion inhibitor.

FIGS. 14A and 14B illustrate additional testing performed on steel rods with a buffering solution that included a combination of a polyalphaolefin (PAO4—SPECTRASYN) and 1.05 wt % of the alkenylsuccinic acid-based corrosion inhibitor as described above. FIG. 14A shows the test results for two steel rods submerged in distilled water and the buffering solution for periods of 4 hours and 24 hours without a pretreating corrosion inhibitor. The images in FIG. 14A show very little corrosion on the steel rods after the submersion in distilled water and buffering solution. FIG. 14B shows test results for two rods that were treated with the isooctyltriethoxysilane pretreating corrosion inhibitor using the same method described above for FIG. 7B. After the pretreating, the two rods in FIG. 14B were submerged in distilled water and the buffering solution for periods of 4 hours and 24 hours. Similar to FIG. 14A, FIG. 14B shows very little corrosion on the steel rods after submersion in the distilled water and buffering solution.

Figure 15A:
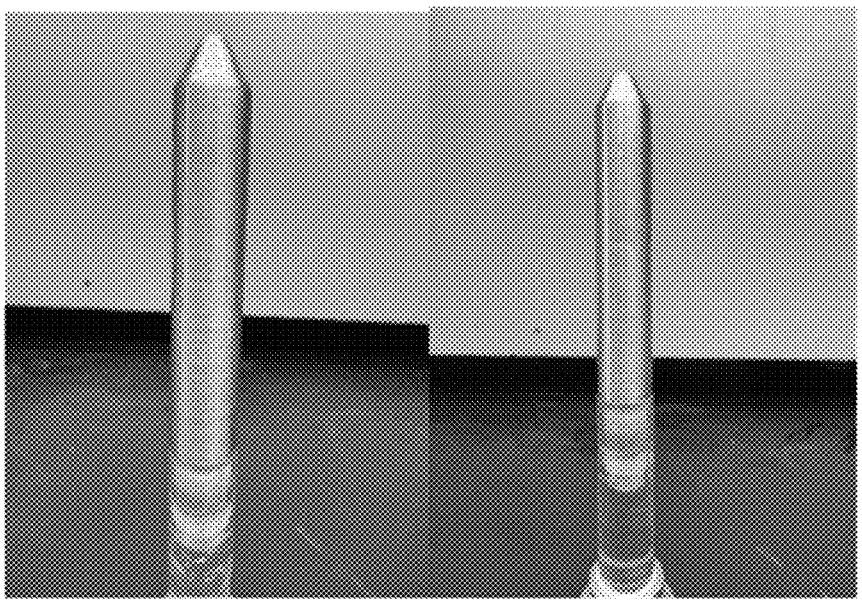
FIG. 15A illustrates ASTM D665 test results for two steel rods, each of which was submerged in distilled water with a buffering fluid comprising a polyalphaolefin and 0.7 wt % of an alkenylsuccinic acid-based corrosion inhibitor.
Figure 15B:
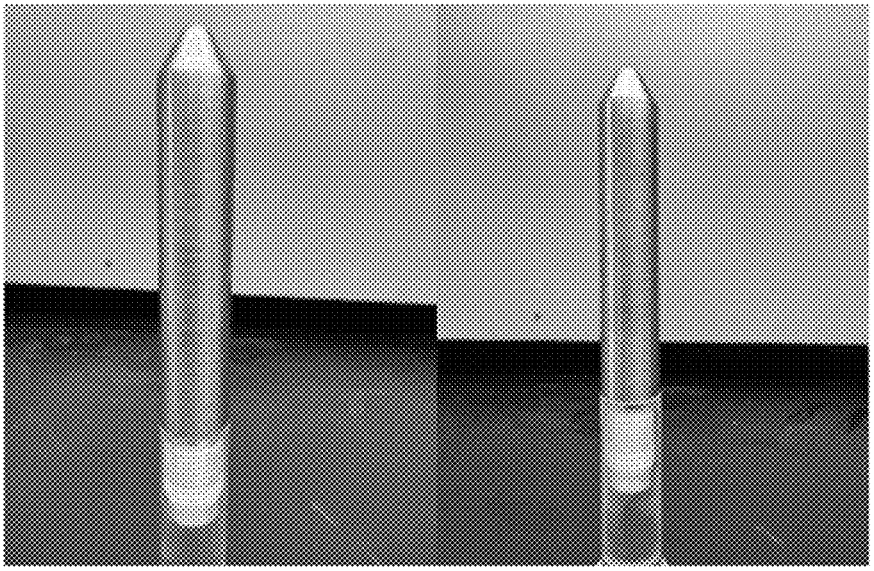
FIG. 15B illustrates ASTM D665 test results for two steel rods, each of which received a silane pretreating corrosion inhibitor followed by submersion in distilled water with a buffering fluid comprising a polyalphaolefin and 0.7 wt % of an alkenylsuccinic acid-based corrosion inhibitor.

FIGS. 15A and 15B illustrate additional testing performed on steel rods with a buffering solution that included a combination of a polyalphaolefin (PAO4—SPECTRASYN) and 0.7 wt % of the alkenylsuccinic acid-based corrosion inhibitor as described above. FIG. 15A shows the test results for two steel rods submerged in distilled water and the buffering solution for periods of 4 hours and 24 hours without a pretreating corrosion inhibitor. The images in FIG. 15A show very little corrosion on the steel rods after the submersion in distilled water and buffering solution. FIG. 15B shows test results for two rods that were treated with the isooctyltriethoxysilane pretreating corrosion inhibitor using the same method described above for FIG. 7B. After the pretreating, the two rods in FIG. 15B were submerged in distilled water and the buffering solution for periods of 4 hours and 24 hours. Similar to FIG. 15A, FIG. 15B shows very little corrosion on the steel rods after submersion in the distilled water and buffering solution.

Figure 16A:
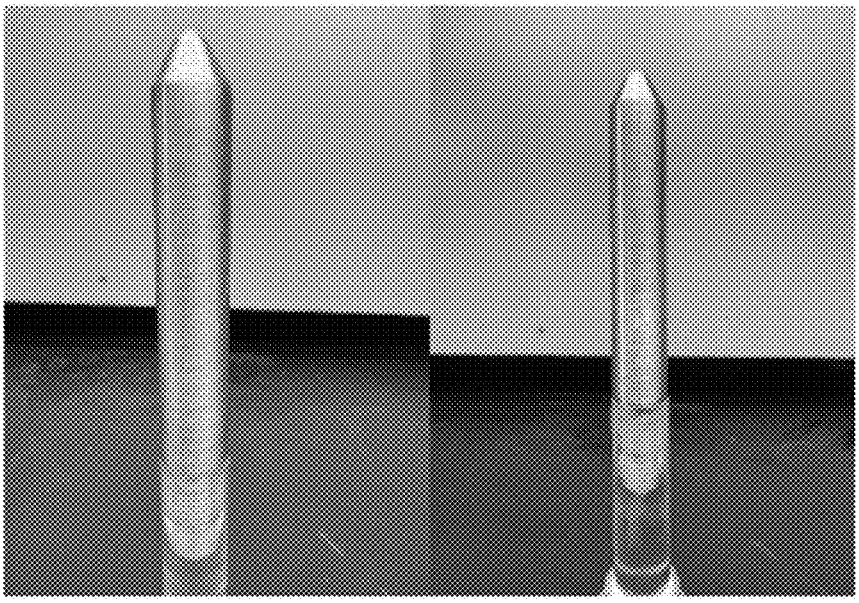
FIG. 16A illustrates ASTM D665 test results for two steel rods, each of which was submerged in distilled water with a buffering fluid comprising a polyalphaolefin and 0.5 wt % of an alkenylsuccinic acid-based corrosion inhibitor.
Figure 16B:
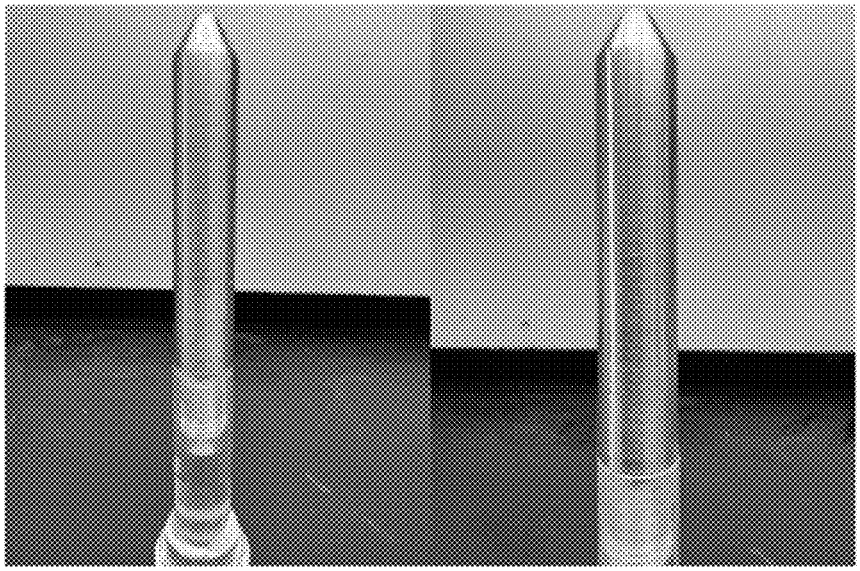
FIG. 16B illustrates ASTM D665 test results for two steel rods, each of which received a silane pretreating corrosion inhibitor followed by submersion in distilled water with a buffering fluid comprising a polyalphaolefin and 0.5 wt % of an alkenylsuccinic acid-based corrosion inhibitor.

FIGS. 16A and 16B illustrate additional testing performed on steel rods with a buffering solution that included a combination of a polyalphaolefin (PAO4—SPECTRASYN) and 0.5 wt % of the alkenylsuccinic acid corrosion inhibitor as described above. FIG. 16A shows the test results for two steel rods submerged in distilled water and the buffering solution for periods of 4 hours and 24 hours without a pretreating corrosion inhibitor. The images in FIG. 16A show very little corrosion on the steel rods after the submersion in distilled water and buffering solution. FIG. 16B shows test results for two rods that were treated with the isooctyltriethoxysilane pretreating corrosion inhibitor using the same method described above for FIG. 7B. After the pretreating, the two rods in FIG. 16B were submerged in distilled water and the buffering solution for periods of 4 hours and 24 hours. Similar to FIG. 16A, FIG. 16B shows very little corrosion on the steel rods after submersion in the distilled water and buffering solution.

From the above description, those skilled in the art will perceive improvements, changes and modifications, which are intended to be covered by the appended claims. While the disclosure includes a limited number of embodiments, those skilled in the art, having the benefit of this disclosure, will appreciate that other embodiments may be devised which do not depart from the scope of the present disclosure.

What is claimed is:

1. A method for preventing or reducing corrosion in an offshore hydrocarbon production facility, comprising:

pumping a buffer fluid comprising one or more passivating agents into an inlet port in a topsides riser end fitting in fluid communication with a plurality of tubes within an annulus of a flexible pipe riser wherein each of the plurality of tubes comprises at least one opening within the annulus, the flexible pipe riser comprising one end terminating at the topsides riser end fitting in fluid communication with the plurality of tubes within the annulus and another end terminating at a subsea riser end fitting; and discharging the fluid from the openings of the plurality of tubes into the annulus such that the fluid flows in the annulus;

wherein the one or more passivating agents comprises one or more of a polyalphaolefin, a polybutene, or a polysiloxane.

2. The method of claim 1, wherein the one or more passivating agents comprises the polyalphaolefin and the polyalphaolefin has a kinematic viscosity of 1.5-5 cSt at 100 degrees C. and is formed from C6-C12 alkenes.

3. The method of claim 1, wherein the buffer fluid comprises the polybutene.

4. The method of claim 3, wherein the polybutene has an average molecular weight of 350 to 510 Daltons, a kinematic viscosity of 3-17 cSt at 100 degrees C., and a pour point of −55 to −30 degrees C.

5. The method of claim 1, wherein the buffer fluid further comprises a corrosion inhibitor.

6. The method of claim 5, wherein the corrosion inhibitor is alkenylsuccinic acid-based corrosion inhibitor.

7. The method of claim 1, further comprising, prior to pumping the buffer fluid comprising one or more passivating agents into the inlet port in the topsides riser end fitting, pumping a pretreating corrosion inhibitor into the inlet port in the topsides riser end fitting.

8. The method of claim 7, wherein the pretreating corrosion inhibitor is one or more of a hydrophobic silane, an amine, an imidazoline, a polymer, a Gemini surfactant, a molybdate, an organic nitrate, a carbonate, a silicate, a phosphate, an anthranilic acid, a thiol, an organic phosphonate, and an organic carboxylate.

9. The method of claim 7, wherein the pretreating corrosion inhibitor comprises isooctyltriethoxysilane.

10. A flexible pipe apparatus for use in an offshore hydrocarbon production facility, the flexible pipe apparatus comprising:

a tubular carcass layer defining a bore therein for transporting produced well fluids;

a pressure sheath surrounding the carcass layer;

an external sheath surrounding the pressure sheath and defining an annulus therebetween; and a plurality of tubes within the annulus and helically wound around at least the pressure sheath; wherein each of the plurality of tubes has at least one opening through which a buffer fluid comprising one or more passivating agents is introduced; wherein surfaces of the pressure sheath and the external sheath in contact with the buffer fluid passing through the annulus are at least partially coated with the one or more passivating agents; and wherein the one or more passivating agents comprises one or more of a polyalphaolefin, a polybutene, or a polysiloxane.

11. The flexible pipe apparatus of claim 10, further comprising:

a topsides end fitting attached to a topsides end of the flexible pipe apparatus, the topsides end fitting having an inlet port in fluid communication with the plurality of tubes within the annulus and an outlet port in fluid communication with the annulus; and a subsea end fitting attached to a subsea end of the flexible pipe apparatus.

12. The flexible pipe apparatus of claim 11, further comprising a segregating wall separating the inlet port from the outlet port.

13. The flexible pipe apparatus of claim 10, wherein the plurality of tubes have solid walls and openings at the ends thereof.

14. The flexible pipe apparatus of claim 10, wherein the plurality of tubes have perforated walls.

15. The flexible pipe apparatus of claim 10, wherein the plurality of tubes are a component of a tape layer free of metal wires and located within the annulus.

16. The flexible pipe apparatus of claim 10, wherein the one or more passivating agents comprises the polyalphaolefin and the polyalphaolefin has a kinematic viscosity of 1.5-5 cSt at 100 degrees C. and is formed from C6-C12 alkenes.

17. The flexible pipe apparatus of claim 10, wherein the one or more passivating agents comprises the polybutene and the polybutene has an average molecular weight of 350 to 510 Daltons, a kinematic viscosity of 3-17 cSt at 100 degrees C., and a pour point of −55 to −30 degrees C.

18. The flexible pipe apparatus of claim 10, wherein the buffer fluid further comprises a corrosion inhibitor.

19. The flexible pipe apparatus of claim 18, wherein the corrosion inhibitor is alkenylsuccinic acid-based corrosion inhibitor.

20. The flexible pipe apparatus of claim 10, further comprising, prior to pumping the buffer fluid comprising the one or more passivating agents into the inlet port in the topsides riser end fitting, pumping a pretreating corrosion inhibitor into the inlet port in the topsides riser end fitting.

21. The flexible pipe apparatus of claim 20, wherein the pretreating corrosion inhibitor is one or more of a hydrophobic silane, an amine, an imidazoline, a polymer, a Gemini surfactant, a molybdate, an organic nitrate, a carbonate, a silicate, a phosphate, an anthranilic acid, a thiol, an organic phosphonate, and an organic carboxylate.

22. The flexible pipe apparatus of claim 20, wherein the pretreating corrosion inhibitor comprises isooctyltriethoxysilane.

* * * * *